US010954658B2

(12) United States Patent
Ross-Kent

(10) Patent No.: US 10,954,658 B2
(45) Date of Patent: Mar. 23, 2021

(54) CISTERN

(71) Applicant: Dylan Hugh Ross-Kent, Salt Rock (ZA)

(72) Inventor: Dylan Hugh Ross-Kent, Salt Rock (ZA)

( * ) Notice: Subject to any disclaimer, the term of this patent is extended or adjusted under 35 U.S.C. 154(b) by 0 days.

(21) Appl. No.: 16/346,397

(22) PCT Filed: Nov. 1, 2017

(86) PCT No.: PCT/ZA2017/050081
§ 371 (c)(1),
(2) Date: Apr. 30, 2019

(87) PCT Pub. No.: WO2018/085867
PCT Pub. Date: May 11, 2018

(65) Prior Publication Data

US 2019/0264433 A1 Aug. 29, 2019

(30) Foreign Application Priority Data

Nov. 2, 2016 (ZA) ..... 2016/07579

(51) Int. Cl.
*E03D 1/14* (2006.01)
*E03C 1/10* (2006.01)
(Continued)

(52) U.S. Cl.
CPC ..... *E03D 1/145* (2013.01); *E03C 1/102* (2013.01); *E03D 1/14* (2013.01); *E03D 1/22* (2013.01); *E03D 9/05* (2013.01); *E03C 2001/026* (2013.01)

(58) Field of Classification Search
CPC ..... E03D 1/0125; E03D 1/22; E03D 1/302; E03D 11/146; E03D 3/04; E03D 3/10;
(Continued)

(56) References Cited

U.S. PATENT DOCUMENTS 375,353 A 12/1887 Harvey
679,687 A 7/1901 Simpson
(Continued)

FOREIGN PATENT DOCUMENTS

CN 104674923 6/2015
DE 20003074 10/2000
(Continued)

OTHER PUBLICATIONS

Search report and written opinion dated Jan. 26, 2018 in International Application Serial No. PCT/ZA2017/050081.
(Continued)

*Primary Examiner* — David P Angwin
*Assistant Examiner* — Nicholas A Ros
(74) *Attorney, Agent, or Firm* — Haugen Law Firm PLLP

(57) ABSTRACT

This invention relates to a cistem (1010): More specifically, the invention relates primarily to concealed cisterns for toilets having integrated, and preferably adjustable, dual-flushing and odour extraction capability. The cistem (1010) includes a primary chamber (1020) for storing a volume of liquid, a liquid inlet (1026) for the primary chamber (1020) of the cistem (1010) with liquid, an air outlet (1028) for exhausting air from the primary chamber (1020) of the cistem (1010) operatively during filling; and a liquid outlet (30) through which liquid operatively stowed in the primary chamber (1020) of the cistem is dischargeable. The cistem (1010) further includes a fill valve for controlling liquid supply into the primary chamber from the liquid inlet (1026) and a flush valve (60) for controlling flow through the liquid outlet (30). The flush valve (60) comprises of a flush valve seat and a flush plug (1064) being moveable relative to the flush valve seat between an open position, wherein the flush plug (1064) is displaced from the flush valve seat thereby to open the liquid outlet (30) and enable the liquid in the
(Continued)

primary chamber (1020) to discharge there through during flushing, and a closed position, wherein the flush plug (1064) is seated on the flush valve seat thereby to close the liquid outlet (30) and prevent the passage of liquid there through. The cistern (1010) also includes at least one actuator (1070) for actuating displacement of the flush plug (1064) from the closed position to the open position, and a controller (1123) for controlling one or more of a group of flushing conditions including: (i) flush type, wherein the cistem (1010) is adjustable between a single flush, dual-flush, on-demand flush or a combination of such flush type conditions; and (ii) flush time, wherein the time of the displacement of the flush plug (1064) by the actuator (1070) for each flush type condition is adjustable.

15 Claims, 8 Drawing Sheets

(51) Int. Cl.
*E03D 1/22* (2006.01)
*E03D 9/05* (2006.01)
*E03C 1/02* (2006.01)

(58) Field of Classification Search
CPC ... E03D 5/028; E03D 9/05–052; E03D 1/145; E03D 1/14
USPC ..... 4/419
See application file for complete search history.

(56) References Cited

U.S. PATENT DOCUMENTS 849,152 A 4/1907 Mendoza
941,895 A 11/1909 Straw
999,619 A 8/1911 Young
1,047,510 A 12/1912 Fraser
1,139,647 A 5/1915 Dehn
1,151,148 A 8/1915 Ainsworth
1,305,145 A 5/1919 Meyer
1,366,028 A 1/1921 Schlag
1,380,415 A 6/1921 Putnam
1,501,620 A 7/1924 Reed
1,538,656 A 5/1925 Richardson
1,586,079 A 5/1926 Formaneck
1,897,492 A 2/1933 Ledoux
2,048,674 A 7/1936 Brannen
2,170,321 A 8/1939 Charroin
2,208,281 A * 7/1940 Sharp ..... E03D 1/308 137/630.14
2,415,875 A 2/1947 Greenwald
2,476,434 A 7/1949 Spang
2,589,691 A 3/1952 Griffon
2,680,853 A 6/1954 Valiente
2,709,264 A 5/1955 Stierlen
2,714,723 A 8/1955 Griffon
2,788,526 A 4/1957 Blain
2,862,210 A 12/1958 Traver
2,871,875 A 2/1959 Dale
2,935,081 A 5/1960 Kryzer
2,957,181 A * 10/1960 Lamping ..... E03D 3/10 4/354
2,959,790 A 11/1960 Nelson
3,041,629 A 7/1962 Pratt
3,104,677 A 9/1963 Fleckenstein et al.
3,192,539 A * 7/1965 Martz ..... E03D 9/052 4/218
3,202,174 A 8/1965 Rudelick
3,324,481 A 6/1967 Emerson et al.
3,491,790 A 1/1970 Sanford
3,553,741 A 1/1971 Owens
3,790,967 A * 2/1974 Pignato ..... E03D 11/146 4/358
3,905,050 A 9/1975 Goza et al.
3,972,076 A 8/1976 Martini
4,185,339 A 1/1980 Morales
4,286,573 A 9/1981 Nickel
4,387,736 A 6/1983 Major
4,858,251 A 8/1989 de Belaunde
4,901,754 A 2/1990 Sable et al.
5,005,225 A 4/1991 Pasquin
5,193,227 A * 3/1993 Crowley, Jr. ..... E03D 9/052 4/213
5,337,781 A 4/1994 Johnson
5,915,408 A 6/1999 Dudley
6,003,541 A 12/1999 Nichols-Roy
6,754,915 B2 6/2004 Mistarz
8,434,172 B2 * 5/2013 Nowak ..... E03D 3/12 4/313
9,499,966 B2 * 11/2016 Darnell ..... E03D 9/05
2007/0125429 A1 6/2007 Kandl
2009/0144890 A1 * 6/2009 Gierer ..... E03D 11/146 4/445
2010/0064427 A1 3/2010 Mehmet
2010/0212756 A1 8/2010 Guthrie
2011/0041750 A1 2/2011 Farber

FOREIGN PATENT DOCUMENTS

EP 2617906 7/2013
FR 744156 4/1933
FR 1093834 5/1955
FR 1111426 2/1956
GB 14721 7/1899
GB 428335 5/1935
WO 0238874 5/2002
WO 2014184776 11/2014

OTHER PUBLICATIONS

Extended Search Report in European Application No. 17868185 dated Apr. 29, 2020.

* cited by examiner

CISTERN

BACKGROUND OF THE INVENTION

THIS invention relates to a cistern. More specifically, the invention relates primarily to concealed cisterns for toilets having integrated, and preferably adjustable, dual-flushing and odour extraction capability.

Cisterns for toilets have been around for many years. Early types required that the cistern be fixed at an elevated location relative to the toilet bowl thereby to provide maximum gravitational water pressure to efficiently flush the toilet bowl.

Over the years, and as aesthetics in the bathroom became more of a priority, the cisterns began to move downwardly closer to the toilet bowl, with sanitary ware manufacturers ultimately making matching cistern and toilet bowl sets with the cisterns being mounted directly to the toilet bowl (commonly known as close coupled suites in Europe, and two-piece sets in the United States of America).

With the cisterns moving from high-level to low-level types, the design of such cisterns and their matching toilet bowls required massive refinement to enable efficient flushing with far less gravitational water pressure. This design refinement, together with water conservation concerns leading to the introduction of dual-flushing capability, have led to the development of cisterns that are seemingly overly complicated, with many incorporating some 20+ working and moving parts.

Although there may be good reason for modem cisterns to be seemingly overly complicated, attempts at manufacturing cisterns with more simplified flushing capability have been made. One such example is taught by VUAGNAT in French patent no. 744156, disclosing a pressurised tank having a vent valve, a flush valve, a hydraulic actuator (comprising a piston movable within a cylinder) for opening and closing the flush valve and a control level for controlling the hydraulic actuator.

Water entering the tank from a pressurised source fills the tank, as well as the cylinder of the hydraulic actuator. As water fills the tank, air therein is vented through an upper vent until the vent valve floats upwardly on the water to seat against and close the upper vent. The water filling of the cylinder of the hydraulic actuator causes the piston to extend from the cylinder thereby to force the flush valve to seat against and close a flush outlet.

In use, depression of the control lever opens a purge line extending from the cylinder through which water contained in the cylinder rapidly exhausts, creating a vacuum in the cylinder and causing the piston to retract into the cylinder thereby to enable the flush valve to open and the remaining water in the tank to discharge via the flush outlet.

The disadvantages of the VUAGNAT invention are at least two. The first is that the invention does not appear to make provision for dual-flush capability. The second is that the working parts, and particularly the hydraulic actuator are located inside of the tank, making them susceptible to damage (i.e. corrosion) and cumbersome to maintain and/or repair.

Another example is taught by BAUMANN in French patent no. 1111426, disclosing a pressurised tank having a flush valve, a bell-shaped catch for catching the flush valve, a mechanical actuator for opening and closing the flush valve and a control level for controlling the hydraulic actuator.

Water entering the tank from a pressurised source fills the tank, pressurising the volume of air previously contained therein until the air pressure and water pressure in the tank equalize. As water fills the tank, the bell-shaped catch too fills with water, displacing air previously contained therein through a one-way vent defined in the catch.

In a filled condition, with the tank and the catch filled with water, the flush valve is seated against a flush outlet thereby to close it. In use, depression of the control lever acts to, via the mechanical actuator, dislodge the flush valve from its seated position to enable water stored in the tank to discharge through the flush outlet. BAUMANN in this patent discusses how a dual-flushing is achieved.

By depressing the control lever only partially through its possible full stroke, the flush valve is lifted from its seated position by a height not sufficient enough for it to escape the forces of the water current/suction acting on it as water discharges through the flush outlet. Accordingly, the flush valve, after momentarily being dislodged, re-seats against and closes the flush valve such that only a small volume of water is allowed to discharge.

By depressing the control lever its full stroke, the flush valve is lifted from its seated position by a height sufficient for it to escape the forces of the water current/suction acting on it, thereby to become buoyant and float to the top of the catch, the flush valve remaining at the catch until all of the water in the tank, followed by all of the water in the catch, has been discharged via the flush outlet. With all of the water discharged, the flush valve falls back into the seated condition to close the flush outlet. In this manner, a larger volume of water may be discharged from the tank.

Although the BAUMANN invention provides for dual-flush capability, it appears that such dual-flush capability is controlled by the operator and not automatically by the cistern itself.

In recent times, odour extraction has also become hugely popular, particularly in public toilet facilities. It will be appreciated that odour extraction is tantamount to germ extraction and, with diarrhea believed to be some seven times more contagious in spreading disease as compared to coughing and sneezing, likely to become mainstream.

Current odour extraction systems are typically retrofit systems that vent odour from the toilet bowl direct or indirectly. In the direct system, the toilet bowl is vented to a sewer line (with a self-contained fan) or an overhead extraction duct having a negative pressure. Where overhead extraction ducts are not available, the toilet bowl is vented to the sewer line, which systems require non-return valves to prevent backdrafts pushing unpleasant odours from the sewers back up into the toilet bowl, and/or carbon filters to mask such odours.

In indirect systems, which are currently most common place, the odours from the toilets are required to escape upwardly from the toilet bowls to be extracted through ceiling level extraction grilles. In essence, this forces the odours and bacteria to travel through the breathing space of the users within the toilet facility, which seems inefficient.

In fact, it often happens that in an attempt to ensure that the environment in a toilet facility remains reasonably pleasant, the air-conditioning infrastructure (ducting, fans, etc.) is over designed. This leads to unnecessary capital expenditure and running costs some 25% more than required as a result of wasted and costly make-up air (i.e. unnecessary supply of air-conditioned air).

Masking sprays are often also used in these facilities, however they only mask odour and bacteria. Studies have shown that many of these masking sprays contain harmful chemicals, with more recent research indicating that some of these chemicals contribute to hormonal abnormalities and birth defects. These masking spray cans & bottles end up contributing to waste landfill sites, which is not environmentally friendly.

More recent market research conducted by the inventor has revealed further complications. For example, different regions or countries stipulate different small and large flush volume requirements (i.e. 4 and 6 litre, 3 and 6 litre, 3 and 4.5 litre, 2.6 and 4 litre). Another example is that other regions require application specific flush characteristics, i.e. single flush for commercial applications (with varied volume requirements) and dual-flush for residential applications.

As a result, and due to traditional flush valves still being in general use, manufactures are forced to manufacture a multitude of slightly differing tank and valve configurations to cater for this varied market demand. It will be appreciated that every tank-valve variation requires a custom mounting system and possibly flush plate, again adding to the complexity and cost of manufacturing processes.

It is an object of the present invention to provide a universal, simple, hygienic, low-maintenance and preferably concealed type of cistern for toilets and/or other applications having integrated dual-flush and extraction capability.

It is a further object of the present invention that the cistem provides easy adjustment of its operative parameters. For example, its flush volume, to cater for the varying requirements of different countries and regions, and its flush force (i.e. through use of adjustable flow restrictors), to accommodate different toilet bowl designs that are also continuously being designed to perform more efficiently, many requiring less water and less flow force.

It is yet a further object of the present invention to make the cistern "smart", in-line with technology trends and the interconnection of devices through the "internet of things".

This will allow the smart cistern, through a mobile application, to record and transmit usage, maintenance and other data, and enable a user to customise operative parameters.

The invention also aims at being environmentally friendly with lower water consumption as compared to many other cisterns available on the market.

SUMMARY OF THE INVENTION

According to the invention there is provided a cistern including:

a primary chamber for storing a volume of liquid;

a liquid inlet for filing the primary chamber of the cistern with liquid;

an air outlet for exhausting air from the primary chamber of the cistern operatively during filling; and a liquid outlet through which liquid operatively stowed in the primary chamber of the cistern is dischargeable;

wherein the cistem further includes:

a fill valve for controlling flow through the air outlet, the fill valve comprising of a fill valve seat and a fill float being buoyant in the liquid and movable relative to the fill valve seat between an open position, wherein the fill float is displaced from the fill valve seat thereby to open the air outlet and enable the air inside the primary chamber to exhaust there through while it is operatively filled with liquid, and a closed position, wherein the fill float buoyantly seats against the fill valve seat so as to: (i) close the air outlet thereby preventing the flow of air or liquid there through; and (ii) pressurise the primary chamber beyond a pressure at which liquid is supplied thereto via the liquid inlet, temporarily terminating further liquid supply into the primary chamber;

a flush valve for controlling flow through the liquid outlet, the flush valve comprising of a flush valve seat and a flush plug being buoyant in the liquid and movable relative to the flush valve seat between an open position, wherein the flush plug is displaced from the flush valve seat thereby to open the liquid outlet and enable the liquid in the primary chamber to discharge there through during flushing, and a closed position, wherein the flush plug is seated on the flush valve seat thereby to close the liquid outlet and prevent the passage of liquid there through; and at least one actuator for actuating displacement of the flush plug from the closed position to the open position;

characterised in that the cistern further includes:

a trap defining: (i) a secondary chamber for trapping therein air and/or the flush plug; (ii) a secondary chamber vent through which air is exhaustible from the secondary chamber of the trap; and (iii) a fluid inlet located between the flush valve seat and the secondary chamber vent, and through which the primary and secondary chambers remain in fluid communication; and a control valve for controlling airflow through the secondary chamber vent, the control valve being capable of actuation between closed and open positions such that in:

a first flushing condition, the control valve and consequentially the secondary chamber vent are operatively closed so as to trap air in the secondary chamber thereby to, during the operative filling of the cistern, prevent liquid from entering into the secondary chamber via the fluid inlet so as to restrict the buoyant movement of the flush plug in the open position to within a force zone in which forces acting thereon by the discharging liquid acts to return the flush plug to the closed position after having operatively enabled a first volume of liquid to discharge through the liquid outlet; and a second flushing condition, the control valve and consequentially the secondary chamber vent are operatively opened so as to simultaneously: (i) exhaust air from the secondary chamber; and (ii) flood the secondary chamber with liquid passing thereinto from the primary chamber via the fluid inlet; thereby to enable the flush plug in the open position to buoyantly move into the trap and beyond the force zone such that the flush plug is returnable to the closed position after having operatively enabled a second and larger volume of liquid to discharge through the liquid outlet.

It will be appreciated that reference to the term "control valve" will be understood to mean a valve through which flow there-through is controllable by external control by a user or control device thereby to controllably open and close the valve.

The cistern may include a fill float catch within which the fill float is housed and guided into engagement with the fill valve seat, the fill float catch defining one or more apertures for enabling passage of liquid from the primary chamber there into so as to impinge on the fill float. The fill float catch may be sized to enable movement of the fill float therein between its open and closed positions, with the fill float catch generally located at or near the fill valve seat.

Typically, the primary chamber tapers toward the fill valve seat and/or the flush valve seat thereby to operatively guide the respective fill float and flush plug into the seated closed position.

Typically, the cistern includes flush plumbing for connecting the cistern to a toilet bowl. The flush plumbing may comprise at least a first end connected to the liquid outlet of the cistern and a second end connectable to a flush inlet of the toilet bowl, nearer the first end of the flush plumbing than to the second end thereof.

Preferably, the flush plumbing includes an actuator housing in which the actuator is housed, with the actuator housing having opposing connectable ends thereby to enable the actuator housing to be installable to and/or removable from the flush plumbing for maintenance, replacement or repair thereof or the actuator, and/or for accessing the liquid outlet of the cistern through which at least the fill float, the flush plug and/or the secondary chamber are installable into and/or removable from the primary chamber.

More preferably, the actuator housing includes a connecting formation, typically in the form of a nut, at each of its connectable ends for, with the actuator housing aligned with threaded piping or fittings making up the flush plumbing, connecting the actuator housing to the flush plumbing.

Most preferably, the cistern includes a flush plate comprising one or more flush buttons or flush sensors through which a user is capable of operatively actuating the actuator. The flush plate is typically locatable over the actuator housing thereby to conceal the actuator housing from external view.

Generally, the actuator housing is a length of piping, and the nuts located on the connectable ends thereof are slip nuts. The actuator housing may be containable within a maintenance container having an access opening through which the actuator housing, the actuator, the liquid outlet of the cistern, the fill float, the flush plug and/or the secondary chamber are accessible, the access opening capable of being closed and/or opened by the respective connecting and/or disconnecting of the flush plate thereover, with the flush plate being fastenable to the maintenance container by magnets or fasteners.

Typically, the cistern also includes a tertiary chamber being in communication with the primary chamber via the air outlet, wherein the tertiary chamber defines: an extraction vent; and an overflow opening connected by the flush plumbing to the toilet bowl through which: (i) liquid overflow from the primary chamber is directable into the toilet bowl; and (ii) fumes are directable from the toilet bowl outwardly towards and beyond the extraction vent thereby to reduce offensive smells, bacteria and airborne disease at or near the toilet bowl.

The flush plumbing preferably includes a tertiary end connected to the overflow opening, the tertiary end being in fluid communication with the second end of the flush plumbing.

In one embodiment, the extraction vent may be connectable to: (i) an outlet through which the toilet bowl fumes are directable to atmosphere; or (ii) ventilation and/or extraction ducting; thereby to generate a negative suction pressure in the toilet bowl.

In an alternative embodiment, the cistern includes a fan for generating a pressure to draw fumes from the toilet bowl, wherein the flush plumbing includes a fan housing in which the fan is housed. The fan housing may include opposing connectable ends thereby to enable the fan housing to be installable to and/or removable from the flush plumbing for maintenance, replacement or repair thereof or the fan, and/or for accessing the overflow opening of the cistern.

Preferably, the fan housing includes a connecting formation, typically in the form of a nut at each of its connectable ends for, with the fan housing aligned with threaded piping or fittings making up the flush plumbing, connecting the fan housing to the flush plumbing.

More preferably, the flush plate is locatable over the fan housing thereby to conceal the fan housing from external view.

Generally, the fan housing is a length of piping and the nuts located on the connectable ends thereof are slip nuts. Furthermore, the fan housing is preferably contained within the maintenance container such that the fan housing, the fan and the overflow opening are accessible through the access opening thereof with the flush plate operatively disconnected from the maintenance container.

Typically, the actuator is a hydraulic actuator comprising a cylinder, a piston movable within the cylinder and a piston rod connected to the piston, with the piston and consequentially the piston rod being moveable between respective extended and retracted conditions. It will be appreciated that the actuator, instead of being a hydraulic actuator (for this embodiment of the invention or any other embodiment described herein), could be another type of actuator, for example, a pneumatic actuator or a electro-mechanical actuator such as a servo or push-pull solenoid.

In the extended condition, the piston rod extends into the primary chamber beyond the liquid outlet thereby to engage and displace the flush plug into the open condition, while in the retracted condition, the piston rod is retracted from the primary chamber and liquid outlet such that the flush plug is free to seat on the flush valve seat in its closed position.

Preferably, the hydraulic actuator includes an actuator supply inlet for supplying liquid to the hydraulic actuator thereby to drive the piston and piston rod into at least one or the other of the extended or retracted conditions.

More preferably, the actuator supply inlet is connectable to a municipal mains or other liquid supply. Furthermore, the hydraulic actuator may include a biasing means for biasing the piston and piston rod into at least one or the other of the extended or retracted conditions. In a preferred configuration, liquid entering the hydraulic actuator via the actuator supply inlet drives the piston and piston rod into the extended condition, while the biasing means (i.e. a spring) biases the piston and piston rod back towards the retracted condition.

Most preferably, the liquid inlet for filing the primary chamber of the cistern with liquid is connectable to the same municipal mains or other liquid supply to which the hydraulic actuator is connectable, with the liquid inlet and the actuator supply inlet being connectable to such municipal mains or other liquid supply by fill plumbing.

The fill plumbing may include a liquid inlet valve for opening or shutting off flow of liquid from the liquid supply into the primary chamber. Furthermore, the fill plumbing may include an actuator supply inlet valve for opening or shutting off flow of liquid to the hydraulic actuator, with the valves being operatively actuated by a user via the flush plate such that:

(i) in the first flushing condition, with the control valve closed thereby to retain air trapped in the secondary chamber of the trap, the actuator supply inlet valve is opened thereby to drive the piston and piston rod into the extended condition so as to unseat the flush plug momentarily to release the first volume of liquid from the primary chamber;

(ii) in the second flushing condition, with the control valve opened to release air from the trap thereby to flood the secondary chamber with liquid, the actuator supply inlet valve is opened thereby to drive the piston and piston rod into the extended condition so as to unseat the flush plug and displace it into the trap thereby to release the second volume of liquid from the primary chamber; and (iii) in other conditions other than the first or the second flushing conditions, with the control valve and the actuator supply inlet valve closed, the liquid inlet valve is opened to allow the flow of liquid through the liquid inlet thereby to fill the primary chamber.

It will be appreciated that reference to the term "momentarily" will be understood to mean a short period of time sufficient to displace the flush plug in accordance with the required volume, for example, between about 0.1 and 5 seconds, more preferably between about 0.1 and 3 seconds, most preferably between about 0.1 and 1 second.

Generally, in the first and second flushing conditions, the liquid inlet valve is closed and the control valve is located along purge plumbing having a first end connected to the secondary chamber vent and a second end connected to the flush plumbing thereby to purge, in the second flushing condition, air trapped in the secondary chamber of the trap into the flush plumbing.

Typically, the cistern includes pressure release plumbing extending from a first end thereof from within the primary chamber and having a second end connected to the flush plumbing, wherein the pressure release plumbing includes:

(i) a pressure reducing valve to reduce the pressure of the liquid supply entering into the primary chamber of the cistern via the liquid inlet, consequentially to maintain the pressure in the primary chamber such that the force acting on the flush plug by the volume of liquid in the primary chamber is less than the force exertable thereon by the actuator to displace the flush plug, as a function of at least the pressure of the liquid supply, the pressure and volume of the tank and the area of the flush plug;

(ii) a pressure relief valve for opening or shutting off flow of small amounts of liquid stored in the primary chamber thereby to release, with the pressure release valve opened during the first or the second flushing condition, pressure from inside the primary chamber such that the hydraulic actuator is capable of more easily moving into the extended condition; and/or (iii) a further pressure relief valve to blow-off pressure in the cistern where the pressure therein exceeds a predefined maximum pressure.

One or more of the valves may be solenoid valves. Alternatively, one or more of the valves are magnetically actuated valves, actuated by valve actuators located on or near the flush plate. More preferably, the valve actuators are at least one first magnetic body and the magnetically actuated valves comprise at least one second magnetic body located thereon such that actuation of the valve actuators actuates the opening and/or closing of the magnetically actuated valve.

The first and the second magnetic bodies may: (i) both be magnets; or (ii) respectively be a magnetic and a member made from a magnetically reactive material, or vice versa; such that:

the valve actuators, through actuation by the flush buttons or flush sensors of the flush plate, are mechanically movable closer to and further away from the second magnetic body of the magnetically actuated valve thereby to cause the magnetically actuated valve to open and close; or the valve actuators and/or the second magnetic body are electrically energisable to cause the magnetically actuated valve to open and close.

It will be appreciated that the magnetically reactive material is typically a ferrous material.

The magnets may be permanent magnets or electromagnets.

Generally, the trap comprises a substantially cup-shaped trap container located within the primary chamber in a substantially upside-down configuration such that a base end of the cup-shaped trap container is spaced further away from the flush valve seat than an open mouth end thereof, and further wherein the secondary chamber vent is defined at or near the base end of the cup-shaped trap container, with the open mouth end thereof being the fluid inlet.

It will be appreciated that the trap container, during flushing, acts to direct liquid exhausting from the primary chamber to a location beneath the displaced flush plug thereby to, particularly in the second flushing condition, enable the flush plug to escape the force zone.

Typically, the trap further comprises a trap mount on which the cup-shaped trap container is mounted in the cistern within the primary chamber.

Preferably, the trap mount is a flush plug catch for catching the displaced flush plug, the flush plug catch being capped at an end spaced from the flush valve seat by the cup-shaped trap container.

More preferably, the flush sensors of the flush plate, or other sensors mounted thereon, on the detection of a user within its vicinity switches on: the fan; and/or attention attracting lights and/or audio.

Most preferably, the cistern has an overall dimension of between about 1500 to 1800 millimetres (height), about 250 to 350 millimetres (width) and 80 to 120 millimetres (depth) such that is may be built into a recess in a wall, fixed behind the wall or located behind/within access panelling or drywalling, with everything other than the flush plate concealed from view. The configuration of the cistern enables it to be fitted within a substantially U-shaped recess in a wall, as viewed downwardly from a top end of the wall.

It will be understood that the force zone lies substantially between the flush valve seat and the fluid inlet of the secondary chamber of the trap, such that operatively, the force zone is defined by the flush valve seat and the liquid level of the liquid at the fluid inlet of the secondary chamber of the trap with air trapped therein.

According to a second aspect of the invention, there is provided a method of operation of a cistern as described herein directly above, including the steps of:

(A) filling the primary chamber thereof with liquid thereby to store a volume of liquid therein;

(B) during the filling of the primary chamber with liquid, trapping air in the secondary chamber of the trap of the cistern, the air being trapped in the secondary chamber of the trap by the liquid having operatively risen to the level of the fluid inlet of the trap and there beyond; and (C) actuating the actuator thereby to displace the flush plug from the closed to the open position, such that:

in the first flushing condition, with the air remaining trapped in the secondary chamber of the trap, the buoyant movement of the displaced flush plug relative to the flush valve seat is restricted to within a force zone in which forces acting thereon by the discharging liquid acts to return the flush plug to the closed position after having operatively enabled the first volume of liquid to discharge through the liquid outlet; and in the second flushing condition, with the air exhausted from the secondary chamber of the trap via the opened control valve and consequentially the opened secondary chamber vent, the liquid floods the secondary chamber of the trap thereby to enable the flush plug to buoyantly move into the trap and beyond the force zone such that the flush plug is returnable to the closed position after having operatively enabled the second volume of liquid to discharge through the liquid outlet.

According to a third aspect of the invention, there is provided a cistern including:

a primary chamber for storing a volume of liquid;

a liquid inlet for filing the primary chamber of the cistern with liquid;

an air outlet for exhausting air from the primary chamber of the cistern operatively during filling; and a liquid outlet through which liquid operatively stowed in the primary chamber of the cistern is dischargeable;

wherein the cistern further includes:

a fill valve for controlling liquid supply into the primary chamber from the liquid inlet;

a flush valve for controlling flow through the liquid outlet, the flush valve comprising of a flush valve seat and a flush plug being movable relative to the flush valve seat between an open position, wherein the flush plug is displaced from the flush valve seat thereby to open the liquid outlet and enable the liquid in the primary chamber to discharge there through during flushing, and a closed position, wherein the flush plug is seated on the flush valve seat thereby to close the liquid outlet and prevent the passage of liquid there through;

at least one actuator for actuating displacement of the flush plug from the closed position to the open position; and a controller for controlling one or more of a group of flushing conditions including:

(i) flush type, wherein the cistern is adjustable between a single flush, dual-flush, on-demand flush or a combination of such flush type conditions; and (ii) flush time, wherein the time of the displacement of the flush plug by the actuator for each flush type condition is adjustable.

Preferably, for the dual-flush type condition, the flush time of the displacement of the flush plug is adjustable by the controller between a first flushing condition, wherein the flush plug is displaced to the open position for a first pre-set time, and a second flushing condition, wherein the flush plug is displaced to the open position for a second pre-set time, characterised in that:

in the first flushing condition, a first volume of liquid is dischargeable through the liquid outlet; and in the second flushing condition, a second and larger volume of liquid is dischargeable through the liquid outlet.

It will be appreciated that the first and second pre-set times may be set differently for different applications (i.e. toilet or urinal flushing) and/or users (male or female), or may be variable in real-time.

Generally, the cistern includes flush plumbing for connecting the cistern to a toilet bowl, with the flush plumbing having at least a first end connected to the liquid outlet of the cistern and a second end connectable to a flush inlet of the toilet bowl. Furthermore, the actuator for displacing the flush plug may be located near the first end of the flush plumbing.

Typically, the flush plumbing includes an actuator housing in which the respective actuator, for displacing the flush plug from the closed position to the open position, is housed. The actuator housing may comprise opposing connectable ends thereby to enable the actuator housing to be installable to and/or removable from the flush plumbing for maintenance, replacement or repair thereof or the actuator, and/or for accessing the liquid outlet of the cistern through which at least parts of the fill valve and the flush plug are installable into and/or removable from the primary chamber.

The actuator housing may also include a connecting formation, typically in the form of a nut, at each of its connectable ends for, with the actuator housing aligned with threaded piping or fittings making up the flush plumbing, connecting the actuator housing to the flush plumbing.

In a preferred embodiment, the controller is controlled via a flush plate comprising one or more flush buttons or flush sensors, through which a user is capable of operatively actuating the actuator, with the flush plate being locatable over the actuator housing thereby to conceal the actuator housing from external view.

Preferably, the actuator housing is a length of piping and the nuts located on the connectable ends thereof are slip nuts. More preferably, the actuator housing is contained within a maintenance container having an access opening through which the actuator housing, the actuator, the liquid outlet of the cistern and at least parts of the fill valve and the flush plug are accessible, with the access opening capable of being closed and/or opened by the respective connecting and/or disconnecting of the flush plate thereover. It will be appreciated that the flush plate is fastenable to the maintenance container by magnets or fasteners.

More preferably, the cistern includes a tertiary chamber being in communication with the primary chamber via the air outlet, wherein the tertiary chamber defines: an extraction vent; and an overflow opening connected by the flush plumbing to the toilet bowl through which: (i) liquid overflow from the primary chamber is directable into the toilet bowl; and (ii) fumes are directable from the toilet bowl outwardly towards and beyond the extraction vent thereby to reduce offensive smells and airborne disease at or near the toilet bowl.

Most preferably, the flush plumbing includes a tertiary end connected to the overflow opening, with the tertiary end being in fluid communication with the second end of the flush plumbing.

In one embodiment, the extraction vent is connectable to: (i) an outlet through which the toilet bowl fumes are directable to atmosphere; or (ii) ventilation and/or extraction ducting; thereby to generate a negative suction pressure in the toilet bowl.

Alternatively, the cistern includes a fan for generating a pressure to draw fumes from the toilet bowl, wherein the flush plumbing includes a fan housing in which the fan is housed. The fan housing may comprise opposing connectable ends thereby to enable the fan housing to be installable to and/or removable from the flush plumbing for maintenance, replacement or repair thereof or the fan, and/or for accessing the overflow opening of the cistern.

Generally, the fan housing includes a connecting formation, typically in the form of a nut at each of its connectable ends for, with the fan housing aligned with threaded piping or fittings making up the flush plumbing, connecting the fan housing to the flush plumbing. Typically, the flush plate is locatable over the fan housing thereby to conceal the fan housing from external view.

Preferably, the fan housing is a length of piping and the nuts located on the connectable ends thereof are slip nuts. Furthermore, the fan housing may be contained within the maintenance container such that the fan housing, the fan and the overflow opening are accessible through the access opening thereof with the flush plate operatively disconnected from the maintenance container.

More preferably, the actuator is a hydraulic actuator comprising a cylinder, a piston movable within the cylinder and a piston rod connected to the piston, with the piston and consequentially the piston rod being moveable between extended and retracted conditions.

In the extended condition, the piston rod extends into the primary chamber beyond the liquid outlet thereby to engage and displace the flush plug into the open condition, while in the retracted condition, the piston rod is retracted from the primary chamber and liquid outlet such that the flush plug is free to seat on the flush valve seat in its closed position.

Most preferably, the hydraulic actuator includes an actuator supply inlet for supplying liquid to the hydraulic actuator thereby to drive the piston and piston rod into at least one or the other of the extended or retracted conditions.

The actuator supply inlet may be connectable to a municipal mains or other liquid supply. Furthermore, the hydraulic actuator may include a biasing means for biasing the piston and piston rod into at least one or the other of the extended or retracted conditions. In a preferred configuration, liquid entering the hydraulic actuator via the actuator supply inlet drives the piston and piston rod into the extended condition, while the biasing means (i.e. a spring) biases the piston and piston rod back towards the retracted condition.

Typically, the liquid inlet for filing the primary chamber of the cistern with liquid is connectable to the same municipal mains or other liquid supply to which the hydraulic actuator is connectable, with the liquid inlet and the actuator supply inlet being connectable to such municipal mains or other liquid supply by fill plumbing.

Generally, the fill plumbing includes a liquid inlet valve, for opening or shutting off flow of liquid from the liquid supply into the primary chamber, and an actuator supply inlet valve, for opening or shutting off flow of liquid to the hydraulic actuator, with the valves being operatively actuated by a user via the flush plate such that:

(i) in the first flushing condition, the actuator supply inlet valve is opened thereby to drive the piston and piston rod into the extended condition so as to unseat the flush plug momentarily to release the first volume of liquid from the primary chamber;

(ii) in the second flushing condition, the actuator supply inlet valve is opened thereby to drive the piston and piston rod into the extended condition so as to displace and unseat the flush plug for a longer period of time thereby to release the second volume of liquid from the primary chamber; and (iii) in other conditions other than the first or the second flushing conditions, with the actuator supply inlet valve closed, the liquid inlet valve is opened to allow the flow of liquid through the liquid inlet thereby to fill the primary chamber.

The cistern may further include pressure release plumbing extending from a first end thereof from within the primary chamber and having a second end connected to the flush plumbing, wherein the pressure release plumbing includes:

(i) a pressure reducing valve to reduce the pressure of the liquid supply entering into the primary chamber of the cistern via the liquid inlet, consequentially to maintain the pressure in the primary chamber such that the force acting on the flush plug by the volume of liquid in the primary chamber is less than the force exertable thereon by the actuator to displace the flush plug, as a function of at least the pressure of the liquid supply, the pressure and volume of the tank and the area of the flush plug;

(ii) a pressure relief valve for opening or shutting off flow of small amounts of liquid stored in the primary chamber thereby to release, with the pressure release valve opened during the first or the second flushing condition, pressure from inside the primary chamber such that the hydraulic actuator is capable of more easily moving into the extended condition; and/or (iii) a further pressure relief valve to blow-off pressure in the cistern where the pressure therein exceeds a predefined maximum pressure.

One or more of the valves may be solenoid valves. Alternatively, one or more of the valves are magnetically actuated valves, actuated by valve actuators located on or near the flush plate. Typically, the valve actuators are at least one first magnetic body and the magnetically actuated valves comprise at least one second magnetic body located thereon such that actuation of the valve actuators actuates the opening and/or closing of the magnetically actuated valve.

Preferably, the first and the second magnetic bodies may: (i) both be magnets; or (ii) respectively be a magnetic and a member made from a magentically reactive material, or vice versa; and further wherein:

the valve actuators, through actuation by the flush buttons or flush sensors of the flush plate, are mechanically movable closer to and further away from the second magnetic body of the magnetically actuated valve thereby to cause the magnetically actuated valve to open and close; or the valve actuators and/or the second magnetic body are electrically energisable to cause the magnetically actuated valve to open and close.

The magnets may be permanent magnets or electromagnets.

Generally, the flush sensors of the flush plate, or other sensors mounted thereon, on the detection of a user within its vicinity switches on: the fan; and/or attention attracting lights and/or audio.

Typically, the fill valve comprises of a fill valve seat and a fill float being buoyantly movable in the liquid between the open and the closed positions, and further wherein the cistern includes a fill float catch within which the fill float is housed and guided into engagement with the fill valve seat. The fill float catch generally defines one or more apertures for enabling passage of liquid from the primary chamber there into so as to impinge on the fill float, wherein the fill float catch is sized to enable movement of the fill float therein between its open and closed positions, with the catch being located at or near the fill valve seat.

Preferably, the primary chamber tapers toward the fill valve seat and/or the flush valve seat thereby to operatively guide the respective fill float and flush plug into the seated closed position.

The flush plug may be buoyant or have a specific gravity greater than the liquid stowable in the primary chamber.

Where the flush plug is buoyant, and as such buoyantly movable in the liquid relative to the flush valve seat, it is preferable that the cistem includes a flush plug catch for catching the displaced flush plug, the flush plug catch: (i) defining one or more apertures for enabling passage of liquid from the primary chamber there into so as to impinge on the flush plug, the flush plug catch being sized to enable movement of the flush plug between its open and closed positions; and (ii) being mounted within the primary cistern at or near the flush valve seat.

Where the flush plug has a specific gravity greater than the liquid stowable in the primary chamber, the flush plug being retainable in the open position by the actuator, held for the duration of the flush time, in the extended condition.

Preferably, the cistem includes a hydro-generator for powering at least the controller and the solenoid valves, and a communications module for enabling the programming of the controller.

Most preferably, the cistern has an overall dimension of between about 1500 to 1800 millimetres (height), about 250 to 350 millimetres (width) and 80 to 120 millimetres (depth) such that is may be built into a recess in a wall, fixed behind the wall or located behind/within access panelling or dry-walling, with everything other than the flush plate concealed from view. The configuration of the cistern enables it to be fitted within a substantially U-shaped recess in a wall, as viewed downwardly from a top end of the wall.

According to a fourth aspect of the invention, there is provided a method of operation of a cistern as described herein directly above, including the steps of:

(A) filling the primary chamber thereof with liquid thereby to store a volume of liquid therein; and (B) actuating the actuator thereby to displace the flush plug from the closed to the open position for predetermined amounts of time controlled by a controller, such that:

in the first flushing condition, the flush plug is displaced to the open position for the first pre-set time thereby to enable the first volume of liquid to discharge through the liquid outlet; and in the second flushing condition, the flush plug is displaced to the open position for the second pre-set time thereby to enable the second volume of liquid to discharge through the liquid outlet.

Accordingly to a fifth aspect of the invention, there is provided a cistern defining:

at least a pair of primary chambers each for storing a separated volume of liquid;

at least one liquid inlet for filing the primary chambers of the cistern with liquid; and at least one air outlet for exhausting air from the primary chambers of the cistern operatively during filling; and a liquid outlet for each of the primary chambers through which liquid operatively stowed in the primary chambers of the cistern is dischargeable;

wherein the cistern further includes:

at least one fill valve for controlling liquid supply into the primary chambers from the liquid inlet;

a flush valve for controlling flow through each of the liquid outlets, wherein at least one of the flush valves comprising of a flush valve seat and a flush plug being movable relative to the flush valve seat between an open position, wherein the flush plug is displaced from the flush valve seat thereby to open the respective liquid outlet and enable the liquid in the primary chamber to discharge there through during flushing, and a closed position, wherein the flush plug is seated on the flush valve seat thereby to close the respective liquid outlet and prevent the passage of liquid there through;

at least one actuator for actuating the opening and/or closing of all or each of the flush valves, wherein at least one of the actuators actuates the displacement of the flush plug from the closed position to the open position;

characterised in that:

in a first flushing condition, only one of the flush valves is opened such that a first volume of liquid is dischargeable through the liquid outlet(s); and in a second flushing condition: (i) both of; or (ii) the other of; the flush valves are/is opened such that a second and larger volume of liquid is dischargeable through the liquid outlet(s).

Typically, the cistern further defines an air outlet for exhausting air from the primary chambers of the cistern operatively during filling, wherein the fill valve controls flow through the air outlet.

Generally, the fill valve comprises of a fill valve seat and a fill float being buoyant in the liquid and movable relative to the fill valve seat between an open position, wherein the fill float is displaced from the fill valve seat thereby to open the air outlet and enable the air inside the primary chamber to exhaust there through while it is operatively filled with liquid, and a closed position, wherein the fill float buoyantly seats against the fill valve seat so as to: (i) close the air outlet thereby preventing the flow of air or liquid there through; and (ii) pressurise the primary chamber beyond a pressure at which liquid is supplied thereto via the liquid inlet, temporarily terminating further liquid supply into the primary chamber.

In one embodiment, the cistern includes a controller for controlling the time of the displacement of the flush plug.

In an alternative and preferred embodiment, the flush plug may be buoyant and as such buoyantly movable in the liquid relative to the flush valve seat between the open and the closed positions.

Whether the flush plug is buoyant or otherwise, the cistern may include a flush plug catch for catching the displaced flush plug, the flush plug catch: (i) defining one or more apertures for enabling passage of liquid from the primary chamber there into so as to impinge on the flush plug, the flush plug catch being sized to enable movement of the flush plug between its open and closed positions; and (ii) being mounted within the primary cistern at or near the flush valve seat.

Generally, the cistern includes flush plumbing for connecting the cistern to a toilet bowl, the flush plumbing having one or more first ends connected to the one or more liquid outlets of the cistern and a second end connectable to a flush inlet of the toilet bowl, wherein the actuators for displacing the one or more flush plugs is located near the respective first ends of the flush plumbing.

Typically, the flush plumbing includes one or more actuator housings for housing each of the one or more actuators, the actuator housings each comprising opposing connectable ends thereby to enable the respective actuator housing to be installable to and/or removable from the flush plumbing for maintenance, replacement or repair thereof or the actuator, and/or for accessing the liquid outlets of the cistern through which at least parts of the fill valve and the flush plug are installable into and/or removable from the primary chamber.

Preferably, each of the actuator housings include a connecting formation, typically in the form of a nut, at each of its connectable ends for, with the actuator housing aligned with threaded piping or fittings making up the flush plumbing, connecting the actuator housing to the flush plumbing.

More preferably, the cistern includes a flush plate comprising one or more flush buttons or flush sensors through which a user is capable of operatively actuating the actuators, directly or via the controller, the flush plate being locatable over the actuator housings thereby to conceal the actuator housings from external view.

Most preferably, each of the actuator housings is a length of piping and the nuts located on the connectable ends thereof are slip nuts. Furthermore, the actuator housing may be contained within a maintenance container having an access opening through which the actuator housing, the actuator, the liquid outlet of the cistern and at least parts of the fill valve and the flush plug are accessible, with the access opening capable of being closed and/or opened by the respective connecting and/or disconnecting of the flush plate thereover, the flush plate being fastenable to the maintenance container by magnets or fasteners.

Generally, the cistern includes a tertiary chamber being in communication with the primary chamber via the air outlet, wherein the tertiary chamber defines: an extraction vent; and an overflow opening connected by the flush plumbing to the toilet bowl through which: (i) liquid overflow from the primary chamber is directable into the toilet bowl; and (ii) fumes are directable from the toilet bowl outwardly towards and beyond the extraction vent thereby to reduce offensive smells and airborne disease at or near the toilet bowl.

Typically, the flush plumbing includes a tertiary end connected to the overflow opening, the tertiary end being in fluid communication with the second end of the flush plumbing.

In one embodiment, the extraction vent is connectable to: (i) an outlet through which the toilet bowl fumes are directable to atmosphere; or (ii) ventilation and/or extraction ducting; thereby to generate a negative suction pressure in the toilet bowl.

Alternatively, the cistern includes a fan for generating pressure to draw fumes from the toilet bowl, wherein the flush plumbing includes a fan housing in which the fan is housed. The fan housing may comprise of opposing connectable ends thereby to enable the fan housing to be installable to and/or removable from the flush plumbing for maintenance, replacement or repair thereof or the fan, and/or for accessing the overflow opening of the cistern.

Preferably, the fan housing includes a connecting formation, typically in the form of a nut at each of its connectable ends for, with the fan housing aligned with threaded piping or fittings making up the flush plumbing, threadably connecting the fan housing to the flush plumbing. It will be appreciated that for this embodiment of the invention, or any other described herein, the nut may be replaced with any other fastening means (i.e. a clip) and will furthermore include a sealing means.

More preferably, the flush plate is locatable over the fan housing thereby to conceal the fan housing from external view.

Most preferably, the fan housing is a length of piping and the nuts located on the connectable ends thereof are slip nuts. Furthermore, the fan housing may be contained within the maintenance container such that the fan housing, the fan and the overflow opening are accessible through the access opening thereof with the flush plate operatively disconnected from the maintenance container.

Generally, the one or more actuators is a hydraulic actuator comprising a cylinder, a piston movable within the cylinder and a piston rod connected to the piston, with the piston and consequentially the piston rod being moveable between extended and retracted conditions.

In the extended condition, the piston rod extends into the respective primary chamber beyond the respective liquid outlet thereby to engage and displace the respective flush plug into the open condition, and a retracted condition, while in the retracted condition, the piston rod is retracted from the primary chamber and liquid outlet such that the flush plug is free to seat on the flush valve seat in its closed position.

Typically, the hydraulic actuator includes an actuator supply inlet for supplying liquid to the hydraulic actuator thereby to drive the piston and piston rod into at least one or the other of the extended or retracted conditions.

Preferably, the actuator supply inlet is connectable to a municipal mains or other liquid supply, and further wherein the hydraulic actuator includes a biasing means for biasing the piston and piston rod into at least one or the other of the extended or retracted conditions. In a preferred configuration, liquid entering the hydraulic actuator via the actuator supply inlet drives the piston and piston rod into the extended condition, while the biasing means (i.e. a spring) biases the piston and piston rod back towards the retracted condition.

More preferably, the liquid inlet for filing the primary chambers of the cistern with liquid is connectable to the same municipal mains or other liquid supply to which the hydraulic actuator is connectable, with the liquid inlet and the actuator supply inlet being connectable to such municipal mains or other liquid supply by fill plumbing.

Generally, the fill plumbing includes a liquid inlet valve, for opening or shutting off flow of liquid from the liquid supply into the primary chambers, and an actuator supply inlet valve, for opening or shutting off flow of liquid to the hydraulic actuator, with the valves being operatively actuated by a user via the flush plate such that:

(i) in the first flushing condition, the respective actuator supply inlet valve is opened thereby to drive the piston and piston rod into the extended condition so as to unseat the flush plug in one of the primary chambers to release the first volume of liquid such primary chamber;

(ii) in the second flushing condition, the respective actuator supply inlet valve is opened thereby to drive the respective piston and piston rod into the extended condition so as to displace and unseat the flush plug in the other of the primary chambers or both of the primary chambers thereby to release the second volume of liquid from the primary chamber(s); and (iii) in other conditions other than the first or the second flushing conditions, with the actuator supply inlet valve closed, the liquid inlet valve is opened to allow the flow of liquid through the liquid inlet thereby to fill the primary chamber.

Typically, the cistern includes pressure release plumbing extending from a first end thereof from within at least one of the primary chambers and having a second end connected to the flush plumbing, wherein the pressure release plumbing includes:

(i) a pressure reducing valve to reduce the pressure of the liquid supply entering into the primary chamber of the cistern via the liquid inlet, consequentially to maintain the pressure in the primary chamber such that the force acting on the flush plug by the volume of liquid in the primary chamber is less than the force exertable thereon by the actuator to displace the flush plug, as a function of at least the pressure of the liquid supply, the pressure and volume of the tank and the area of the flush plug;

(ii) a pressure relief valve for opening or shutting off flow of small amounts of liquid stored in the primary chamber thereby to release, with the pressure release valve opened during the first or the second flushing condition, pressure from inside the primary chamber such that the hydraulic actuator is capable of more easily moving into the extended condition; and/or (iii) a further pressure relief valve to blow-off pressure in the cistern where the pressure therein exceeds a predefined maximum pressure.

One or more of the valves may be solenoid valves. Alternatively, one or more of the valves are magnetically actuated valves, actuated by valve actuators located on or near the flush plate. More preferably, the valve actuators are at least one first magnetic body and the magnetically actuated valves comprise at least one second magnetic body located thereon such that actuation of the valve actuators actuates the opening and/or closing of the magnetically actuated valve.

Most preferably, the first and the second magnetic bodies may: (i) both be magnets; or (ii) respectively be a magnetic and a member made from a magentically reactive material, or vice versa; and further wherein:

the valve actuators, through actuation by the flush buttons or flush sensors of the flush plate, are mechanically movable closer to and further away from the second magnetic body of the magnetically actuated valve thereby to cause the magnetically actuated valve to open and close; or the valve actuators and/or the second magnetic body are electrically energisable to cause the magnetically actuated valve to open and close.

Generally, the magnets are permanent magnets or electromagnets.

Typically, the flush sensors of the flush plate, or other sensors mounted thereon, on the detection of a user within its vicinity switches on: the fan; and/or attention attracting lights and/or audio.

Preferably, the primary chambers each taper toward their respective fill valve seat and/or their respective flush valve seat thereby to operatively guide the respective fill float and flush plug into the seated closed position.

Most preferably, the cistern has an overall dimension of between about 1500 to 1800 millimetres (height), about 250 to 350 millimetres (width) and 80 to 120 millimetres (depth) such that is may be built into a recess in a wall, fixed behind the wall or located behind/within access panelling or drywalling, with everything other than the flush plate concealed from view. The configuration of the cistern enables it to be fitted within a substantially U-shaped recess in a wall, as viewed downwardly from a top end of the wall.

According to a sixth aspect of the invention, there is provided a method of operation of a cistern as described herein directly above, including the steps of:

(A) filling the pair of the primary chambers with liquid thereby to store respective volume a of liquid therein; and (B) actuating the actuator thereby to displace the flush plugs from the closed to the open position, such that:

in the first flushing condition, only one of the flush valves is opened such that the first volume of liquid is dischargeable through the liquid outlet(s); and in the second flushing condition: (i) both of; or (ii) the other of; the flush valves are/is opened such that the second volume of liquid is dischargeable through the liquid outlet(s).

BRIEF DESCRIPTION OF THE INVENTION

The invention will now be described in more detail, by way of example only, with reference to the accompanying illustrations, in which.

DETAILED DESCRIPTION OF THE INVENTION

Figure 1:
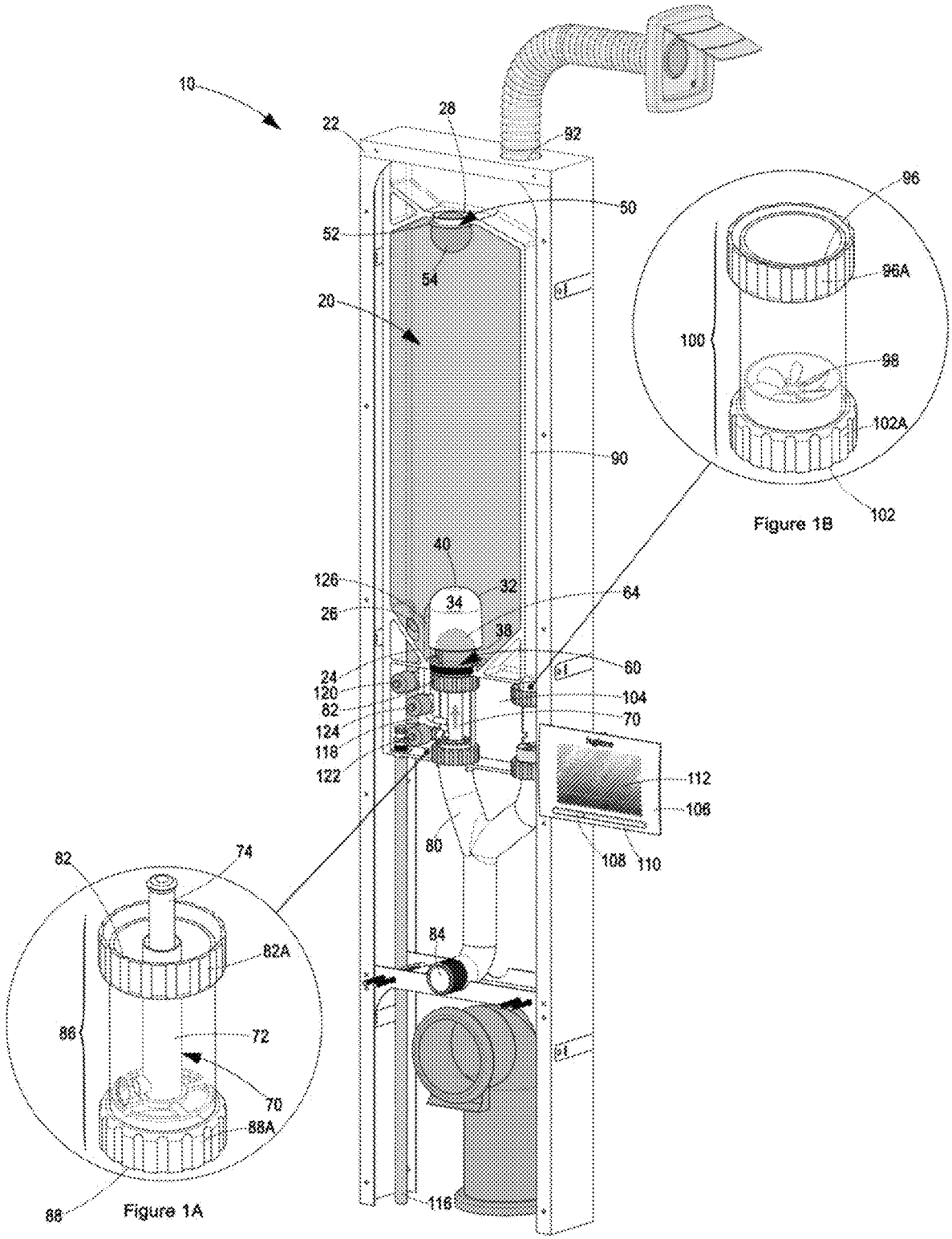
FIG. 1 is a perspective view of a first embodiment of a cistern in accordance with the present invention.
Figure 2:
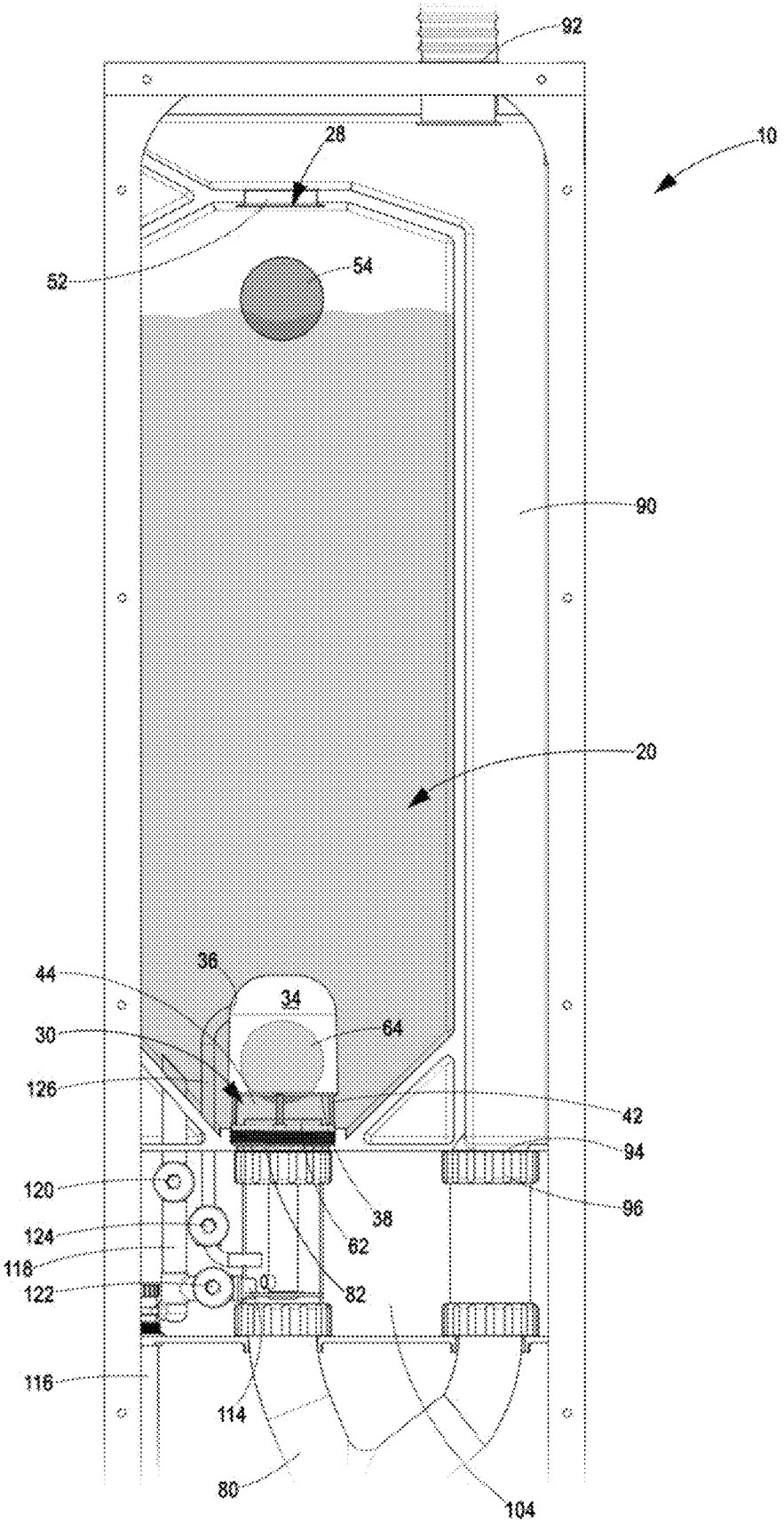
FIG. 2 is a front view of the cistern of FIG. 1 in a first flushing condition.

A cistern according to first embodiment of the invention is designated generally in FIG. 1 and FIG. 2 by reference numeral 10. The cistern 10 comprises a primary chamber 20 for holding a volume of liquid (such as water, being represented in the figures by grey shading), a fill valve 50 operative at an upper end 22 of the primary chamber 20, a flush valve 60 operative at a lower end 24 of the primary chamber 20 and an actuator 70 positioned operatively beneath the flush valve 60 and outside of the primary chamber 20, which is one of many advantages of the cistern 10.

The primary chamber 20 defines the liquid inlet 26 for filing the primary chamber 20 with liquid, an air outlet 28 through which air is exhaustable from the primary chamber 20 and a liquid outlet 30 through which liquid stowed in the primary chamber 20 is dischargeable from the primary chamber 20 of the cistern 10.

Figure 3:
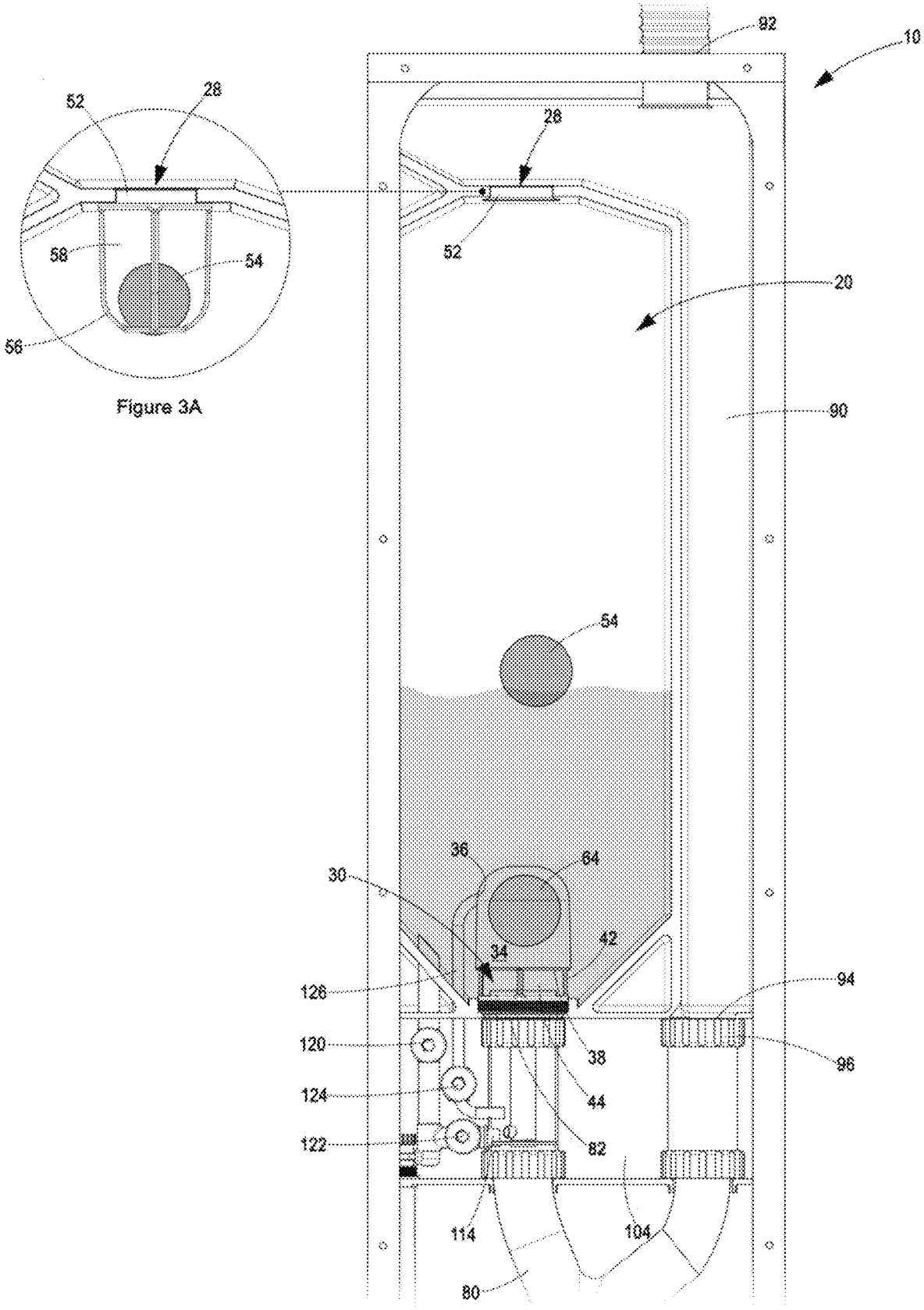
FIG. 3 is a front view of the cistern of FIG. 1 in a second flushing condition.

The fill valve 50 comprises of a fill valve seat 52 and a fill float 54 being buoyantly movable on the liquid relative to the fill valve seat 52 between respective open and closed positions, which will be described in greater detail later in the description. As illustrated in FIG. 3A, and although the fill float 54 may be freely movable within the volume of primary chamber 20, the cistern 10 may include a fill float catch 56, mounted about the fill valve seat 52, for housing the fill float 54 and restricting its movement to within a zone near such fill valve seat 52.

In the open position of the fill valve 50, the fill float 54 is displaced from the fill valve seat 52 thereby to open the air outlet 28 and enable the air inside the primary chamber 20 to exhaust there through while the primary chamber 20 is operatively filled with liquid via the liquid inlet 26. In the closed position of the fill valve 50, the fill float 54 buoyantly seats against the fill valve seat 52 so as to not only close the air outlet 28 thereby preventing the flow of air or liquid there through, but also pressurise the primary chamber 20 beyond or equal to a pressure at which liquid is supplied thereto via the liquid inlet 26, temporarily terminating further liquid supply into the primary chamber 20.

It will be appreciated that the fill valve 50 operates like a scupper valve, commonly found on boats.

Furthermore, and together with or in substitution to the tapering upper end 22 of the primary chamber 20, the fill float catch 56 guides the fill float 54 into engagement with the fill valve seat 52 as the fill float 54 rises into the closed condition in use. The fill float catch 56, defines one or more apertures 58 or is in the form of a cage, allows liquid to pass therethrough and impinge on the fill float 54. In this manner, the fill float 54 becomes buoyant as the liquid level in the primary chamber 20 rises operatively upwardly into contact with and beyond the float catch 56 towards the fill valve seat 52.

The flush valve 60 comprises of a flush valve seat 62 and a flush plug 64 being buoyantly movable on the liquid relative to the flush valve seat 62 between respective open and closed positions, which will be described in greater detail later in the description. A trap 32 is located within the primary chamber 20 of the cistem 10. The trap 32 defines a secondary chamber 34 therein, a secondary chamber vent 36 and a fluid inlet 38, which fluid inlet 38 is located between the flush valve seat 62 and the secondary chamber vent 36.

More specifically, the trap 32 is substantially cup-shaped and located within the primary chamber 20 in a substantially upside-down configuration. The trap 32 comprises a base end 40 spaced further away from the flush valve seat 62 than an open mouth end thereof, which open mouth end is the fluid inlet 38 of the trap 32. For the cistern 10 to operate in the manner required, the secondary chamber vent 36 is defined at or near the base end 40 of the trap 32.

The trap 32 is mounted about and above the flush valve seat 62 on a trap mount 42, which trap mount 42 spaces the fluid inlet 38 operatively above the flush valve seat 62 and defines apertures 44 therein to allow liquid to flow from the primary chamber 20, through the trap mount 42 and outwardly via liquid outlet 30.

In a preferred embodiment, the trap mount 42 may be a flush plug catch, much the same as the fill float catch 56, capped at an operative top end with the cup-shaped trap 32. Furthermore, and together with or in substitution to the tapering lower end 24 of the primary chamber 20, the trap 32 and specifically the flush plug catch 42 guides the flush plug 64 into engagement with the flush valve seat 62 as the flush plug 64 moves operatively downwardly, due to a lose in buoyancy as the liquid discharges from the primary chamber 20.

In the open position of the flush valve 60, the flush plug 64 s displaced from the flush valve seat 62 thereby to open the liquid outlet 30 and enable the liquid in the primary chamber 20 to discharge there through during flushing. In the closed position of the flush valve 60, the flush plug 64 is seated on the flush valve seat 62 thereby to close the liquid outlet 30 and prevent the passage of liquid there through.

The cistern 10 further includes flush plumbing 80 (which in use would typically incorporate a flush pipe of a toilet) for connecting the cistern 10 to a toilet bowl (not shown). More specifically, the flush plumbing 80 comprises at least a first end 82 connected to the liquid outlet 30 of the cistern 10 and a second end 84 connectable to a flush inlet of the toilet bowl.

The actuator 70, located near the first end 82 of the flush plumbing 80, is housed within an actuator housing 86, in the form of a length of pipe, having opposing connectable ends 82, 88. Each of the opposing ends 82, 88 of the actuator housing 86 comprise slip nuts 82A, 88A (also known in the industry as a union fitting) thereby to enable the actuator housing 86 to be installable to and/or removable from the flush plumbing 80 for maintenance, replacement or repair of the actuator housing 86 and/or the actuator 70.

It will be appreciated that the liquid outlet 30 of the cistern is accessible with the actuator housing 86 removed from the flush plumbing 80. This is one of many advantages of the cistern 10, as access to the liquid outlet 30 enables any one or more of the trap 32, the fill valve seat 52, the fill float 54, the fill float catch 56, the flush valve seat 62 and the flush plug 64 to be installable to and/or removable from the primary chamber 20 for maintenance, replacement or repair.

In a particularly preferred embodiment of the invention, the cistern 20 also includes a tertiary chamber 90, being in communication with the primary chamber 20 via the air outlet 28. In the preferred embodiment illustrated in the accompanying figures, the tertiary chamber 90 flanks the primary chamber 20 and, at an upper end thereof, extends above the primary chamber 20, such that the tertiary chamber 90 takes a substantially upside-down L-shape. It will be appreciated that the cistern may be designed in many different manners such that the chambers take different shapes and configurations.

The tertiary chamber 90 defines an extraction vent 92 and an overflow opening 94 connected to the toilet bowl by the flush plumbing 80, the overflow opening 94 being connected to a tertiary end 96 of such flush plumbing 80, such that the flush plumbing 80 takes a substantially Y-shaped form. It will be appreciated that the tertiary chamber 90 acts as one or both of an overflow chamber and an extraction chamber.

In operation, any overflow of liquid passing from the primary chamber 20 through the fill valve 50, under normal operation or failure of such valve 50, is directable via the tertiary chamber 90 (acting as an overflow chamber), through the overflow opening 94 and into the flush plumbing 80 to be discarded into the toilet bowl.

Simultaneously, and with the tertiary chamber 90 acting as an extraction chamber, fumes and/or germs from the toilet bowl are extractable therefrom via the flush plumbing 80, through the tertiary chamber 90 and outwardly via the extraction vent 92. This is yet another advantage of the cistern 10, which advantage reduces offensive smells and airborne disease at or near the toilet bowl.

It is envisaged that the fumes and/or germs from the toilet bowl may be drawn into and beyond the tertiary chamber 90 using multiple methods, two of which will now be discussed in greater detail. The first method, envisaged for use mainly in commercial applications, is by connecting the extraction vent 92 to existing extraction ducting infrastructure in a building. In this manner, the negative pressure in the extraction ducting is communicated into the tertiary chamber 90, thereby to create suction therein for drawing the fumes and/or germs from the toilet bowl.

The second method, envisaged for use mainly in domestic applications, is by including in the flush plumbing 80, at a location near the tertiary end 96 thereof, a fan 98 for positively displacing the fumes and/or germs from the toilet bowl into and beyond the tertiary chamber 90. It will be appreciated that the fan may be any form of blowing or suction device that would provide the same or similar effect as the fan.

The fan 98 is housed in a fan housing 100 (typically a length of pipe), which fan housing 100 is part of the flush plumbing 80 and includes opposing connectable ends 96, 102 having thereon slip nuts 96A, 102A for enable the fan housing 100 to be installable to and/or removable from the flush plumbing 80 for maintenance, replacement or repair thereof and/or the fan 98 housed therein. It will be appreciated that with the fan housing 100 removed, the overflow opening 94 of the tertiary chamber 90 is accessible.

It is further envisaged that both the actuator housing 86 and the fan housing 100 will be contained within a maintenance container 104, a maintenance box of sorts, having an access opening (i.e. a hatch) capable of been opened and closed by a 106 (i.e. a hatch cover), being removably fastenable to the maintenance container 104 over such access opening, thereby to conceal the actuator housing 86 and the fan housing 100 from view.

In this manner, and for example where the cistern is built into a masonry wall, all working components of the cistern 10 (i.e the trap 32, the fill valve seat 52, the fill float 54, the fill float catch 56, the flush valve seat 62, the flush plug 64, the actuator 70, actuator housing 86, the fan 98 and the fan housing 100) are accessible for maintenance, replacement or repair by, without having to break the wall, removing the flush plate 106 from the maintenance container 104 and thereafter, removing the actuator housing 86 and the fan housing 100 from the flush plumbing 80.

It will be appreciated that it may be difficult to remove certain of the components, i.e. the fill and flush valve seats 52, through the maintenance container. Accordingly, these may be manufactured from a harder wearing material, with the fill float 54 and the flush plug 64 being manufactured from a softer material such that only the latter (i.e. and not the seats) require replacement.

The flush plate 106, the operation of which will be explained in greater detail later in this description, generally comprises two flush buttons 108, 110, for actuating the flushing of the cistern 10 with dual flush capability.

It will be appreciated that instead of buttons, the flush plate 106 could have sensors for sensing the presence of a person (i.e. a microwave switch), thereby eliminating the need for a user to physically touch the flush plate 106 to flush the toilet. It will be appreciated further that such sensors, or other sensing means, could also be used to switch on the fan 98 and/or attention attracting lights 112 (preferably light emitting diodes) or audio. Furthermore, it is envisaged that the flush plate 106 will make use of novel markings to ensure that the user selects the correct flushing condition, possibly through touch-less or soft-touch capacitive sensors.

The actuator 70 is a hydraulic actuator comprising a cylinder 72, a piston (not shown) movable within the cylinder and a piston rod 74 connected to the piston and extending from the cylinder 72, the piston and consequentially the piston rod 74 being moveable between respective extended and retracted conditions relative to the cylinder 72.

In the extended condition, the piston rod 74 extends into the primary chamber 20 beyond the liquid outlet 30 thereby to engage and displace the flush plug 64 into its open condition. In the retracted condition, the piston rod 74 is retracted from the primary chamber 20 and liquid outlet 30 such that the flush plug 64 is free to seat on the flush valve seat 62 in its closed position.

The hydraulic actuator 70 includes an actuator supply inlet 114 for supplying liquid thereto to drive the piston and piston rod 42 into the extended condition. Preferably, the hydraulic actuator 70 includes a biasing means (not shown) for, on shutting off liquid supply thereto, biasing the hydraulic actuator 70 back toward its retracted condition.

A further advantage of the cistern 10 is its simple operation, owed largely to the ability to fill the cistern 10 with liquid, as well as actuating the flushing thereof with one and the same municipal mains or other liquid supply, represented in the illustrations by liquid supply line 116, via fill plumbing 118 comprising a liquid inlet valve 120 and an actuator supply inlet valve 122.

The liquid inlet valve 120 opens and/or shuts off flow of liquid from the liquid supply line 116 into the primary chamber 20 via the liquid inlet 26. The actuator supply inlet valve 122 opens and/or shuts off flow of liquid to the hydraulic actuator 70. The valves 120, 122 are operatively actuatable via the flush plate 106, which will be described in greater detail later in this description.

The cistern 10 further includes a control valve 124 located along purge plumbing, more specifically a purge line 126, connected at one end to the secondary chamber vent 36 of the trap 32, and at an opposite end to the flush plumbing 80.

The control valve 124 controls airflow through the secondary chamber vent 36 and is actuated, as are the liquid inlet and the actuator supply inlet valves 120, 122, by the flush plate 106 between closed and open positions to consequentially actuate one or the other of a first flushing condition or a second flushing condition, which will be described in greater detail below.

In use, and while the cistern 10 is being filled, the liquid rises upwardly from the lower end 24 of the primary chamber 20, to and beyond the level of the fluid inlet 38 (i.e. the open mouth end) of the trap 32. It will be appreciated that as the liquid, as it moves beyond the open mouth end 38 of the traps 32, traps a volume of air in the secondary chamber 34 thereof, as represented in the figures with the trap 32 shown without any shading when filled with air.

Figures 4A, 4B, 4C, 4D, 4E:
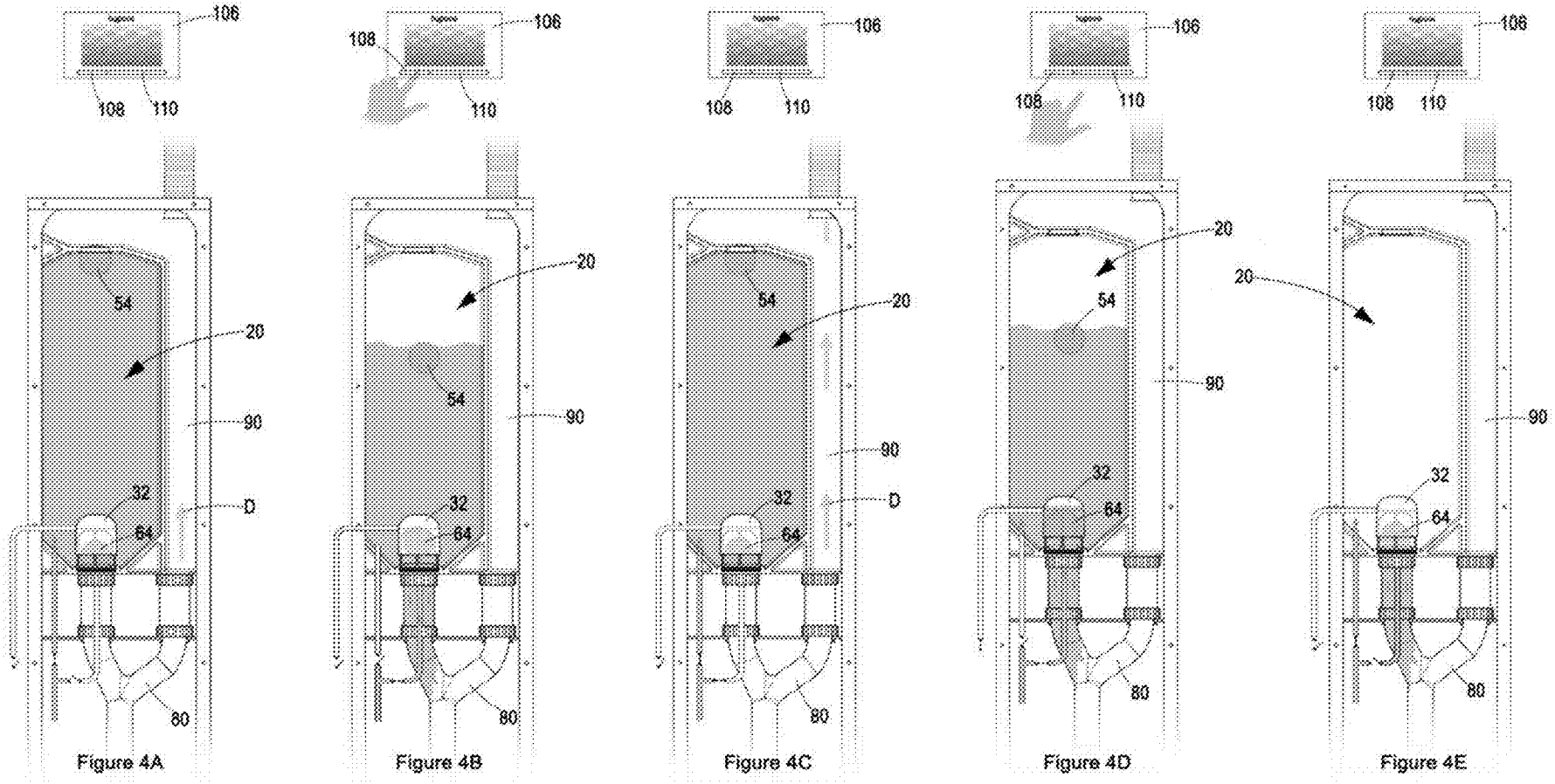
FIG. 4A-4E are front views of the cistern of FIG. 1, showing various filling and flushing conditions.

In a filled condition, as shown in FIG. 1 and FIG. 4A, the control valve 124 is closed, consequentially closing the secondary chamber vent 36 thereby to keep the air trapped in the secondary chamber 34 of the trap 32, so as to prevent any liquid from entering into the secondary chamber 34 thereof.

In this filled condition, the cistern 10 is ready to be flushed in the first flushing condition or the second flushing condition. In the first flushing condition, attainable for example by depression of the first flush button 108 as illustrated in FIG. 4B, and while the control valve 124 remains closed, the liquid inlet valve 120 is momentarily closed and the actuator supply inlet valve 122 is momentarily opened.

The closed liquid inlet valve 120 shuts off flow to the primary chamber 20 such the liquid from the liquid supply line 116 is redirected through the opened actuator supply inlet valve 122, thereby to drive the actuator 70 into the extended condition such the piston rod 74 displaces the flush plug 64 from its seated closed position into its open position.

With the flush plug 64 being buoyant, the flush plug 64 rises upwardly toward the trap 32. Without any liquid present in the secondary chamber 34 of the trap 32, due to this space being occupied by the trapped air, the flush plug 64 is incapable of buoyantly rising beyond a force zone within which forces acting thereon, by the liquid now discharging out of the primary chamber 20 through the flush valve seat 62 and into the liquid outlet 30, return the flush plug 64 to the closed position after having operatively enabled a first volume of liquid to discharge from the cistern 10.

It will be appreciated, as previously indicated, that the force zone lies substantially between the flush valve seat 62 and the fluid inlet 38 of the secondary chamber 34 of the trap 32, within which force zone suction forces and/or other fluid dynamic forces act on the flush plug 64 to return it to the closed position. It will be appreciated further that following a strike of the flush button 108, and after momentarily closing and opening the respective liquid inlet and actuator supply inlet valves 120,122, such valves are returned to their respective normally open and closed positions.

With the valves 120,122 respectively returned to their normally opened and closed positions, liquid again enters into the primary chamber 20 thereby to return the cistern to its filled condition as illustrated in FIG. 4C.

With the cistern 10 returned to its filled condition, and with reference to FIG. 4D, the second flushing condition is attainable, for example, by depression of the second flush button 110, actuating the momentary closing of the liquid inlet valve 120, opening of the actuator supply inlet valve 122 and the opening of the control valve 124, consequentially purging the trapped air in the secondary chamber 34 therefrom via the secondary chamber vent 36 and into the flush plumbing 80 via the purge line 126.

The closed liquid inlet valve 120 shuts off flow to the primary chamber 20 such the liquid from the liquid supply line 116 is redirected through the opened actuator supply inlet valve 122, thereby to drive the actuator 70 into the extended condition such the piston rod 74 displaces the flush plug 64 from its seated closed position into its open position.

With the air purged from the trap 32, liquid from the primary chamber 20 enters the secondary chamber 34 of the trap 32 via the fluid inlet 38 thereof, thereby to flood the secondary chamber 34 with liquid. The flush plug 64, having been dislodged by the actuator 70 into its open position, buoyantly rises upwardly into the secondary chamber 34 of the trap 32 now flooded with liquid, and beyond the force zone, such that the flush plug 64 is returnable to the closed position only after having operatively enabled a second and larger volume of liquid to discharge through the flush valve seat 62 and into the liquid outlet 30.

It will be appreciated that the trap 32, particularly during the second flushing condition, acts to direct liquid exhausting from the primary chamber 20 to a location beneath the displaced flush plug 64 thereby to further assist the flush plug 64 to escape the force zone.

With all of liquid discharged from the primary chamber 20, as illustrated in FIG. 4E, the flush plug 64, no longer having liquid to remain buoyant, falls under the force of gravity back into its closed condition.

In this manner, using hydraulic and mechanical means, simple dual flushing capability is attained. It will be appreciated that following a strike of the flush button 110, and after momentarily closing the liquid inlet valve 120 and opening both the actuator supply inlet and control valves 122, 124, such valves are returned to their respective normally open and closed positions.

With the valves 120,122, 124 respectively returned to their normally opened and closed positions, liquid again enters into the primary chamber 20 thereby to return the cistern 10 to its filled condition as illustrated in FIG. 4A or 4C.

The valves 120,122, 124 are preferably magnetically actuated valves, each valve having thereon a first magnetic body being co-operative with respective second magnetic bodies, movement or energising of the latter being actuated by the striking of the flush buttons 108, 110 on the flush plate 106. The first and the second magnetic bodies may both be magnets, respectively be a magnetic and a member made from a magnetically reactive material, or vice versa.

During use, it will be appreciated that the striking of the flush buttons 108, 110 will also switch off the extraction fan during flushing as depicted by the directional arrows "D" in FIG. 4, where connection to extraction ducting does not already supply a negative pressure for constant extraction.

Figure 5B:
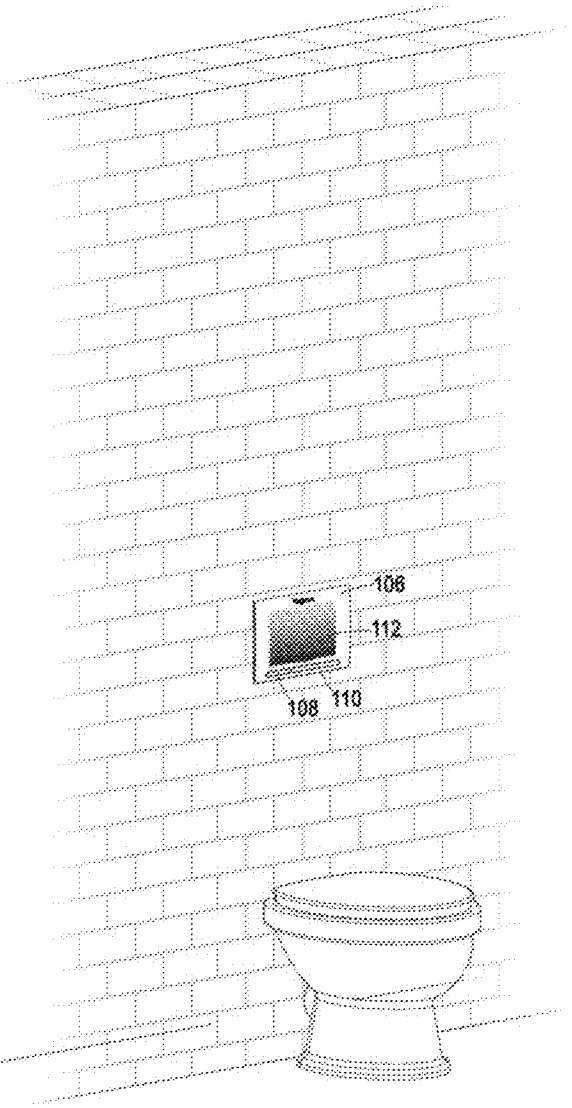
FIG. 5B is a perspective view of the cistern of FIG. 5A, showing the built-in cistern concealed from view by the wall with nothing by a being visible.
Figure 5A:
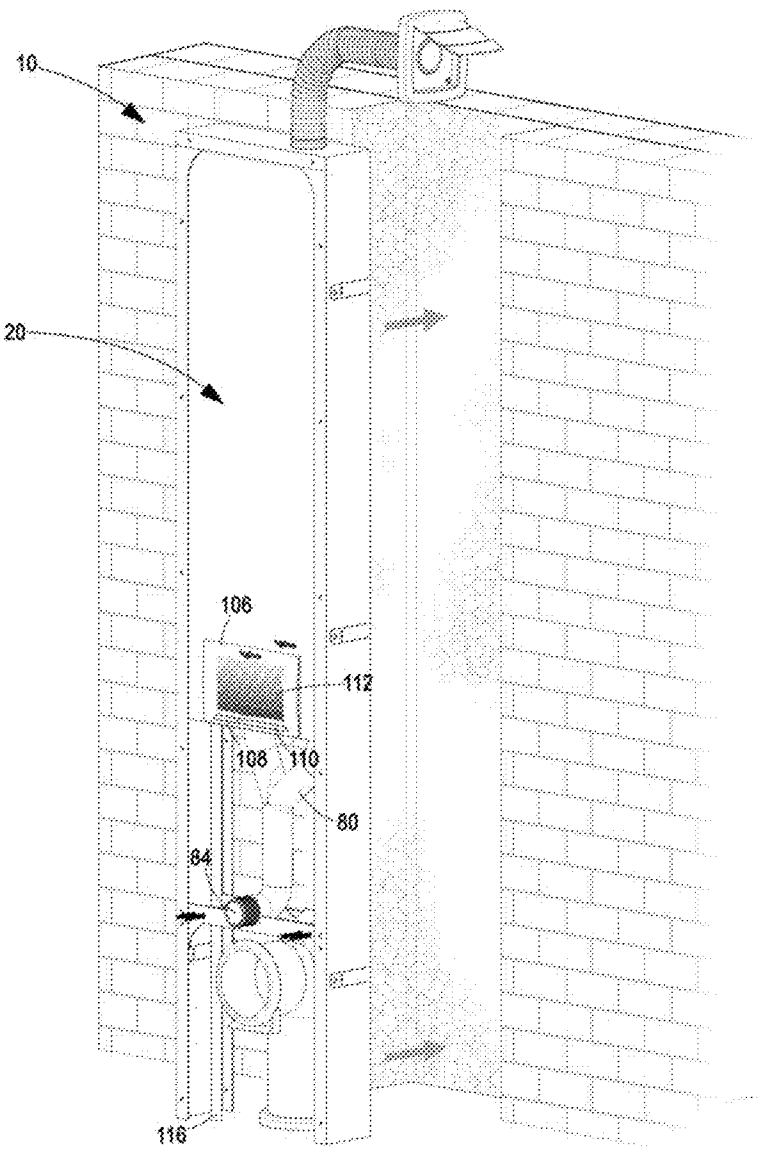
FIG. 5A is a perspective view of the cistern of FIG. 1 relative to a recess in a wall in which it is operably receivable.

A further advantage of the cistern 10 is its shape and dimensions, which enable it to be built into a wall within a shallow recess defined in a wall between substantially vertical and parallel lines chased into such wall, as illustrated in FIG. 5. This makes installation quick and easy.

The first embodiment of the invention as described above is a mechanical low-cost version of the cistern, ideal for applications where electrical power is unavailable, and where skilled labour for fixing and maintaining electrical and/or electronic appliances are scarce. What follows is a description of a second embodiment of the invention, as depicted in FIGS. 6A to 6D, being an electrically powered version of the cistem.

With reference now to FIGS. 6A to 6D, and with like references designating like parts, what follows is a brief explanation as to the differences in the parts and operation between the first and second embodiments of the invention 10, 1010. It will be appreciated that other than the parts and operation differences described herein, the remaining parts and operation of the first and second embodiments of the invention remain substantially the same.

The cistern 1010 of the second embodiment may have the same general shape and character the cistern 10 of the first embodiment, or a slightly modified version thereof wherein the liquid inlet 1026, for filling the primary chamber 1020 with liquid, is located operatively above the overflow level, being the air outlet 1028 of the cistern 1010, thereby to define an "airgap" between the liquid inlet 1026 and the liquid air outlet 1028.

To comply with British Standards Air Gap Regulations, the "air gap" between the abovementioned inlet and outlet 1026, 1028 is preferably at least 20 millimetres such that if a negative pressure is experienced on the liquid inlet line 1026, air and not water is sucked back into such line, thereby to prevent contamination of a mains water supply.

By comparison of the cisterns 10, 1010 of the first and second embodiments of the invention, the more obvious part differences that can be observed is the exclusion in the cistern 1010 the trap 32, and consequentially the exclusion of the secondary chamber 34, the secondary chamber vent 36, the fluid inlet 38, the trap mount 42 and the purge line 126 and associate valve 124.

Less obvious part differences are:

- the substitution of a buoyant flush plug 64 with a flush plug 1064 having a specific gravity greater than the liquid stowable in the primary chamber 1020;
- the replacement of the magnetically actuated valves with solenoid type valves;
- the introduction of a controller 1123 for controlling an amount of time during which the actuator 1070 is retained in its extended condition, thereby to displace the float plug 1064 into its open position; and
- the requirement for an electrical power supply.

Furthermore, and with reference to the maintenance container 1104 of the cistern 1010, it will be appreciated that instead of depicting the components required for the actuation of the filling and flushing of the cistern 1010 therein, that a schematic representation (see FIG. 8) be used to better describe the operation.

Figure 8:
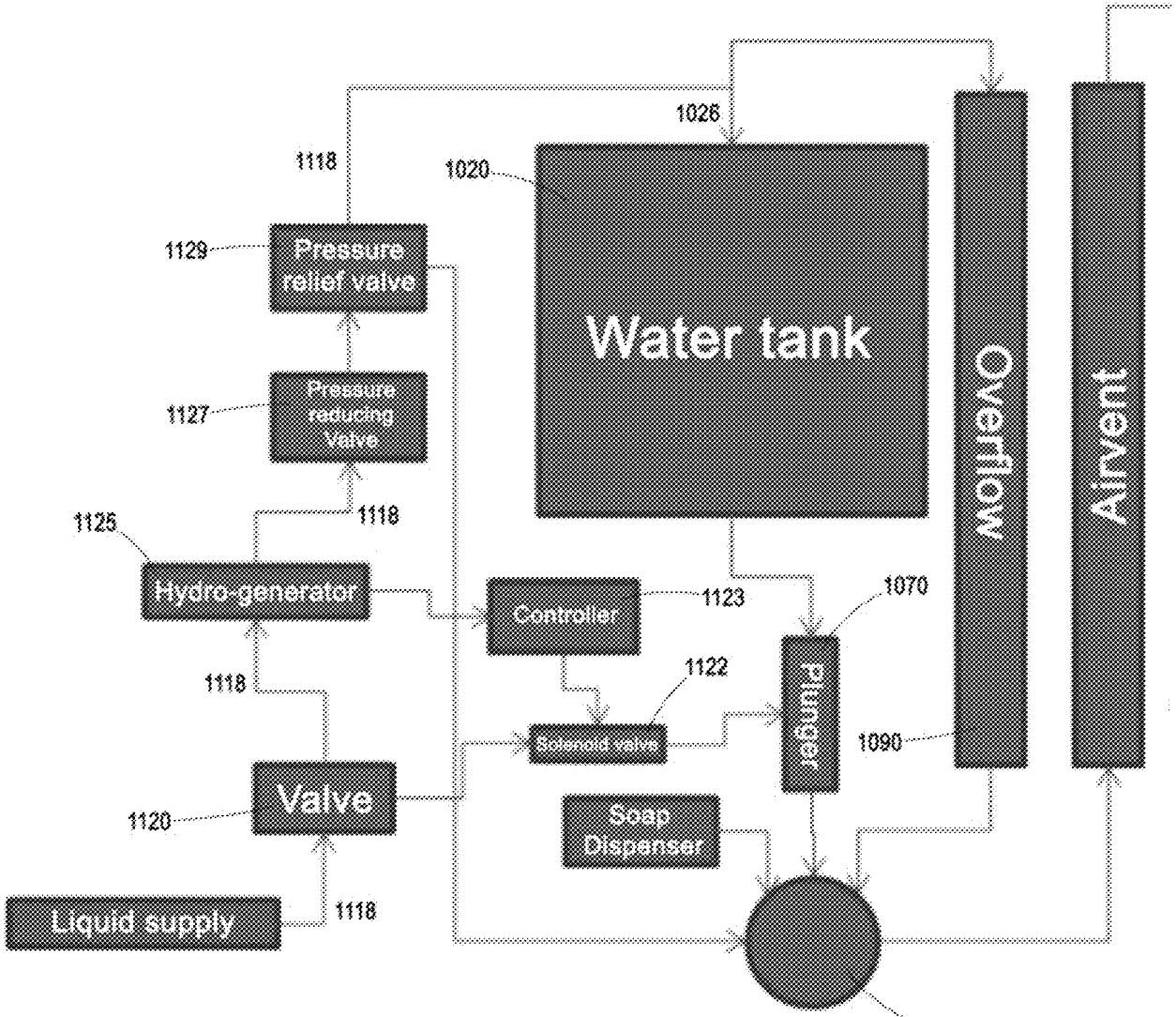
FIG. 8 is a schematic representation of the working components of the second embodiment of the invention.

With reference to FIG. 8, the liquid inlet 1026 is fed via the fill plumbing 1118 comprising a liquid inlet shut-off valve 1120 and an actuator supply inlet solenoid valve 1122, with at least the latter being controlled by the controller 1123.

In one version of this second embodiment, at least the controller 1123 and the actuator supply inlet solenoid valve 1122 is powered via a mains electricity supply. In another version of the second embodiment, and as depicted in FIG. 8, at least the controller 1123 and the actuator supply inlet solenoid valve 1122 is powered by a power storage device, i.e. a battery or capacitor, receiving power from a hydro-generator 1125 located along the fill plumbing 1118 and being driven by the liquid supply (i.e. a mains water supply) during the filling of the cistern 1010.

It is envisaged that the controller 1123 will comprise at least a printed circuit board (PCB), the power storage device and a communications module (i.e. a blue tooth communications module) for communicating with the controller 1123 via an electronic device, such a cellular telephone, via a software application.

After having passed through the hydro-generator 1125, the liquid from the liquid supply operative passes through a pressure-reducing valve 1127, then through a pressure relief valve 1129, which in an alternative embodiment could be integrated into the flush valve as a collapsible seal, and finally to the liquid inlet 1026 to fill the primary chamber 1020.

It will be appreciated that the controller 1123, during or pre-installation, is programmed with the required flushing conditions made up of a flush type (single flush, dual-flush, on-demand flush) and a flush time, the latter being associated with the volume of liquid the cistern 1010 must dispense for the programmed flush type.

Figures 6A, 6B, 6C, 6D:
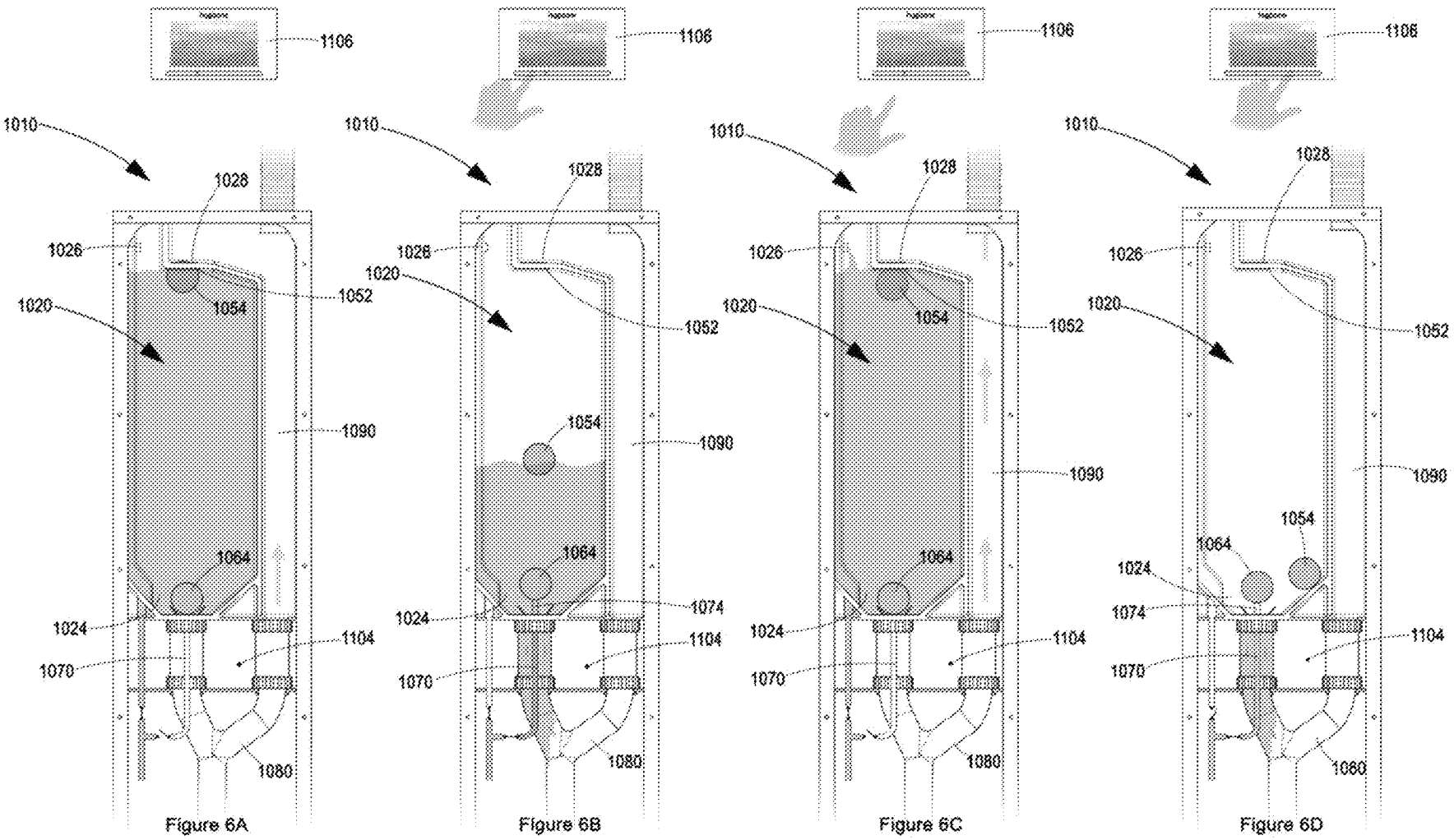
FIG. 6A-6D are front views of a second embodiment of a cistern in accordance with the present invention, showing various filling and flushing conditions.

In the filled condition, and as depicted in FIG. 6A, the fill float 1054 seats against the fill valve seat 1052, causing the pressure in the primary chamber 1020 to increase to a value beyond or equal to the pressure of the liquid inlet 1026, thereby to automatically shut-off further liquid supply into the primary chamber 1026. It will be appreciated that the pressure at the liquid supply inlet 1026, and consequentially the pressure in the primary chamber 1020 in the filled condition, is such that the force acting on the flush plug 1064 is less than the force exertable thereon by the actuator 1070 to displace the flush plug 1064 for flushing.

In most applications, it is envisaged that the controller 1123 will be set for a dual-flush flush type, having a first flushing condition, wherein the flush plug 1064 is displaced to the open position for a first pre-set time, and a second flushing condition, wherein the flush plug 1064 is displaced to the open position for a second pre-set time, characterised in that in the first flushing condition, a first volume of liquid is dischargeable through the liquid outlet and in the second flushing condition, a second and larger volume of liquid is dischargeable through the liquid outlet.

In use, and with the cistern 1010 in the filled condition as depicted in FIG. 6A, a user triggers a first flushing condition via the flush plate 1106 causing the controller 1123 to open the actuator supply inlet solenoid valve 1122 thereby to divert flow from the liquid supply to the actuator 1070.

As illustrated in FIG. 68, the liquid hydraulically drives the piston rod 1074 of the actuator 1070 from the retracted condition to the extended condition for a first pre-set time, consequentially displacing the flush plug 1064 and holding it in the open position to flush the first volume of liquid. Once the first pre-set time has lapsed, the controller 1123 closes the actuator supply inlet solenoid valve 1122, returning the piston rod 1074 of the actuator 1070 to retracted condition and consequentially the flush plug 1064 to the closed position enabling the primary chamber 1020 to be re-filled as depicted in FIG. 6C.

Similarly, the user may trigger a second flushing condition via the flush plate 1106 causing the controller 1123 to open the actuator supply inlet solenoid valve 1122 thereby to divert flow from the liquid supply to the actuator 1070.

As illustrated in FIG. 6D, the liquid hydraulically drives the piston rod 1074 of the actuator 1070 from the retracted condition to the extended condition for a second pre-set time, consequentially displacing the flush plug 1064 and holding it in the open position to flush the second volume of liquid. Once the second pre-set time has lapsed, the controller 1123 closes the actuator supply inlet solenoid valve 1122, returning the piston rod 1074 of the actuator 1070 to retracted condition and consequentially the flush plug 1064 to the closed position enabling the primary chamber 1020 to be re-filled.

As a further water-saving feature, the controller 1123 will monitor the operation of the hydro-generator 1125, which is expected to operate only during the filling of the cistern 1010. It will be appreciated then that if the hydro-generator 1125 is operative other than during filling, there is a high likelihood that there may be a leak, which under normal conditions, would only visibly manifest itself as brownish markings in the bowl of the toilet after many months of water losses. Accordingly, it will be appreciated that the hydro-generator acts as a power supply and a leak detection device.

It will be appreciated that this embodiment of the cistern 1010 may, instead of working with a timed controller and incorporating a "sinking" flush plug 1064, could work on a similar principle to that of the cistern 10 described above having a buoyant flush plug 64 and a cup-shaped trap or catch 1032 for receiving such buoyant flush plug 64. The trap or catch 1032 need not be airtight, and needs simply act to catch the flush plug 64 and direct liquid exhausting the primary chamber 1020 to beneath the flush plug 1064 thereby to assist its release from the force zone. Furthermore, the cistern 1010 could also work with the "sinking" flush plug and trap combination so as to prevent the flush plug from straying to far away from the flush valve whilst the flush plug is in the open position.

Figures 7A, 7B, 7C, 7D:
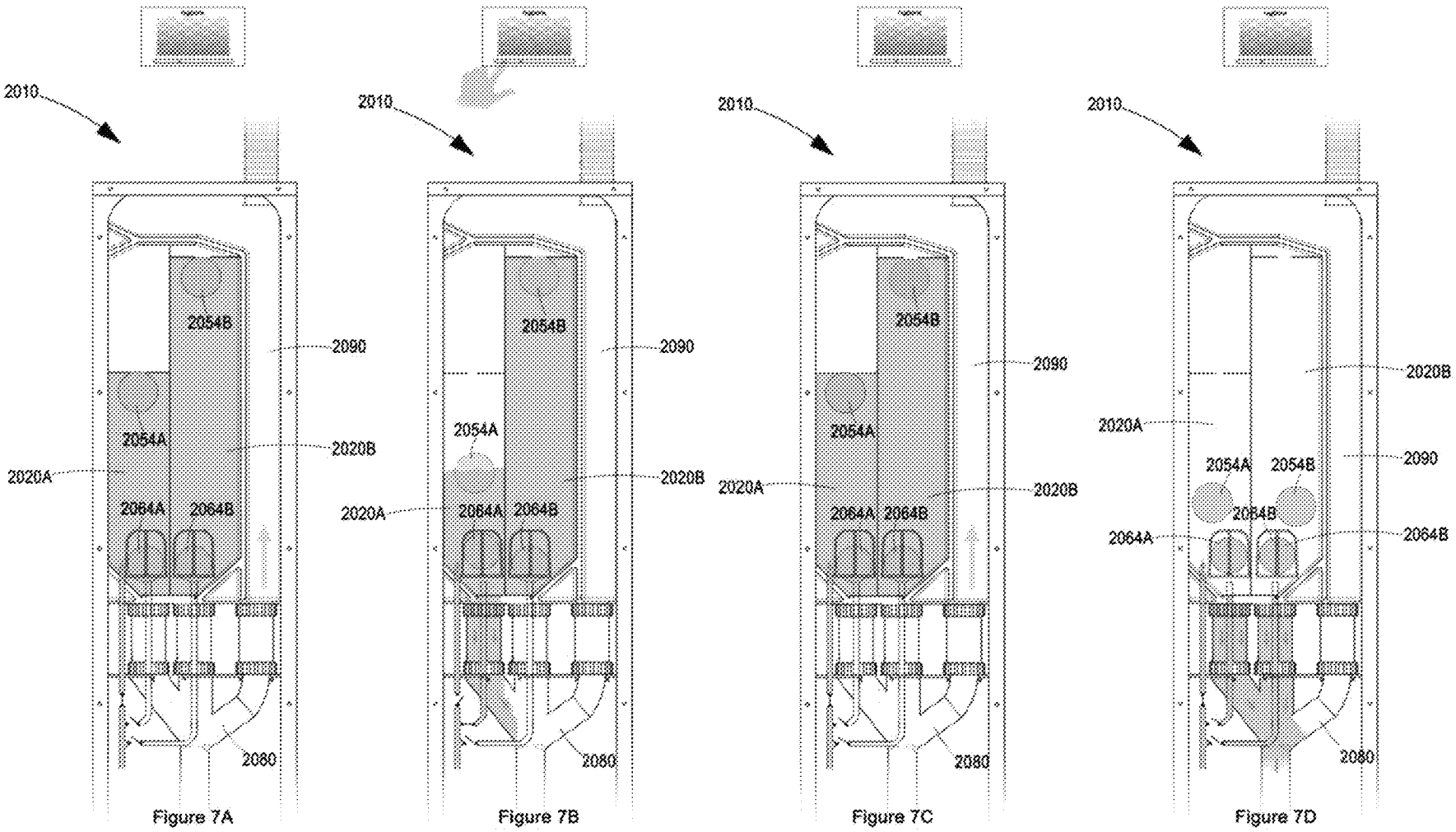
FIG. 7A-7D are front views of a third embodiment of a cistern in accordance with the present invention, showing various filling and flushing conditions.

With reference now to a further embodiment of the invention, as depicted in FIG. 7, and again with like references designating like parts, the cistern 2010 may have a pair of primary chamber 2020A, 2020B for discharging different first and second volumes of liquid under the respective first and second flushing conditions. In this embodiment, the first flushing condition is attainable by opening only the first of a pair of flush plugs 1064A (as depicted in FIG. 7B), while the second flushing condition is attainable by opening the second of the flush plugs 1064B, or both of the flush plugs 106A, 1064B (as depicted in FIG. 7D).

Although the invention has been described with reference to a preferred embodiment, it will be appreciated that many modifications or variations of the invention are possible without departing from the spirit or scope of the invention.

For example, the cistern 10 may include pressure release plumbing extending from a first end thereof from within the primary chamber 20 and having a second end connected to the flush plumbing 80, wherein the pressure release plumbing includes a pressure reducing valve to reduce the pressure of the liquid supply entering into the primary chamber of the cistern via the liquid inlet, consequentially to maintain the pressure in the primary chamber such that the force acting on the flush plug by the volume of liquid in the primary chamber is less than the force exertable thereon by the actuator to displace the flush plug, as a function of at least the pressure of the liquid supply, the pressure and volume of the tank and the area of the flush plug;

Alternatively and/or supplementary to the aforementioned pressure reducing valve, the pressure release plumbing may include a pressure relief valve for opening or shutting off flow of small amounts of liquid stored in the primary chamber 20 thereby to release, with the pressure release valve opened during the first or the second flushing condition, pressure from inside the primary chamber 20 such that the hydraulic actuator 70 is capable of more easily moving into the extended condition.

Furthermore, the pressure release plumbing may also comprise of a further pressure relief valve to blow-off pressure in the cistern where the pressure therein exceeds a predefined maximum pressure.

In another example, and although the cistern of the present invention has been described with reference to use with toilets, it will be appreciated that the cistern may be used in many other applications—for instance, to flush urinals.

In yet another example, the depressurisation of the tank 20 during flush activation could happen by valve 120 being a 3-way valve that dumps water into chamber 86 and 80 during flushing.

It will be appreciated that by making the cistern "smart", through the building into the controller of a communications module that enables communication with a software application on a mobile phone, many advantages may be unlocked. For example:

flush type and time programming of the controller without having direct access thereto;

auto flush programming for automatically flushing the toilet after its last flush thereby to prevent the water trap from drying out, and/or to prevent the water and piping from becoming stagnant and contaminated (particularly useful for holiday houses and seasonal facilities);

access to on-demand installation manuals;

end-to-end tracking of the cistern from production to installation, including at least installation date, location, user and installer information, as well as operational and usage statistics tracking;

fan speed and duration settings;

flush plate attention attracting light settings (and/or display settings where the flush plate is any one of a touch screen, glass, aluminium, stainless steel or plastic);

warranty registration and tracking;

proximity advertising;

leak detection alarms; and service interval notifications.

The invention claimed is:

1. A cistern defining:

a primary chamber for storing a volume of liquid;

a liquid inlet for filling the primary chamber of the cistern with liquid;

an air outlet for exhausting air from the primary chamber of the cistern operatively during filling; and a liquid outlet through which liquid operatively stowed in the primary chamber of the cistern is dischargeable;

wherein the cistern further includes:

a fill valve for controlling liquid supply into the primary chamber from the liquid inlet;

a flush valve for controlling flow through the liquid outlet, the flush valve comprising of a flush valve seat and a flush plug being movable relative to the flush valve seat between an open position, wherein the flush plug is displaced from the flush valve seat thereby to open the liquid outlet and enable the liquid in the primary chamber to discharge there through during flushing, and a closed position, wherein the flush plug is seated on the flush valve seat thereby to close the liquid outlet and prevent the passage of liquid there through, the flush valve seat and flush plug being configured to be passable through the liquid outlet;

at least one actuator for actuating displacement of the flush plug from the closed position to the open position;

flush plumbing for connecting the cistern to a toilet bowl, the flush plumbing comprising at least:

(i) a first end connected to the liquid outlet of the cistern;

(ii) a second end connectable to a flush inlet of the toilet bowl; and (iii) an actuator housing in which the actuator is housed and located near the first end of the flush plumbing, the actuator housing comprises opposing connectable ends thereby to enable the actuator housing to be installable to and removable from the flush plumbing for maintenance, replacement or repair thereof or the actuator, or for accessing the liquid outlet of the cistern through which at least parts of the flush valve are installable into and removable from the primary chamber; and a controller for controlling a flush type selected from:

(i) a single flush comprising one of a first flushing condition and a second flushing condition; and (ii) a dual flush comprising both of the first flushing condition and the second flushing condition;

wherein the first flushing condition has a first flush time, and the second flushing condition has a second flush time, with the first flush time being less than the second flush time, and each of the first and second flush times being defined by a respective time period of displacement of the flush plug by the actuator, the controller being adapted to adjust the time period of displacement of the flush plug in response to an input instruction signal, characterised in that, and locatable beneath the primary chamber, the cistern further includes:

a maintenance container in which at least the actuator housing is contained and accessible through an access opening of the maintenance container; and a flush plate for generating and transmitting the input instruction signal to the controller, the flush plate comprising one or more flush buttons or flush sensors through which a user is capable of directing the flush plate to generate and transmit the input instruction to the controller, wherein the access opening of the maintenance container is capable of being closed and opened by the respective connecting and disconnecting of the flush plate thereover such that the flush plate is locatable over the actuator housing, thereby to conceal the actuator housing from external view.

2. A cistern according to claim 1, wherein for the first flushing condition, a first volume of liquid is dischargeable through the liquid outlet; and in the second flushing condition, a second and larger volume of liquid is dischargeable through the liquid outlet.

3. A cistern according to claim 2, wherein the actuator housing includes a connecting formation at each of its connectable ends for, with the actuator housing aligned with threaded piping or fittings making up the flush plumbing, connecting the actuator housing to the flush plumbing.

4. A cistern according to claim 3, wherein the actuator housing is a length of piping and, together with the actuator, the liquid outlet of the cistern and at least parts of the flush valve being accessible via the access opening of the maintenance container, the flush plate being fastenable to the maintenance container by magnets or fasteners.

5. A cistern according to claim 4 including a tertiary chamber being in communication with the primary chamber via the air outlet, wherein the tertiary chamber defines:

an extraction vent being connectable to: (i) an outlet through which the toilet bowl fumes are directable to atmosphere; or (ii) ventilation or extraction ducting; thereby to generate a negative suction pressure in the toilet bowl; and an overflow opening connected by the flush plumbing to the toilet bowl through which: (i) liquid overflow from the primary chamber is directable into the toilet bowl; and (ii) fumes are directable from the toilet bowl outwardly towards and beyond the extraction vent thereby to reduce offensive smells and airborne disease at or near the toilet bowl; and further wherein the flush plumbing includes a tertiary end connected to the overflow opening, the tertiary end being in fluid communication with the second end of the flush plumbing.

6. A cistern according to claim 5 including a fan for generating a pressure to draw fumes from the toilet bowl, wherein the flush plumbing includes a fan housing in which the fan is housed, the fan housing having opposing connectable ends thereby to enable the fan housing to be installable to and removable from the flush plumbing for maintenance, replacement or repair thereof or the fan, or for accessing the overflow opening of the cistern; and further wherein the fan housing includes connecting formations at each of its connectable ends for connecting the fan housing to the flush plumbing.

7. A cistern according to claim 6, wherein the flush plate is locatable over the fan housing thereby to conceal the fan housing from external view; and further wherein the fan housing is contained within the maintenance container such that the fan housing, the fan and the overflow opening are accessible through the access opening thereof with the flush plate operatively disconnected from the maintenance container.

8. A cistern according to claim 2, wherein the actuator is a hydraulic actuator comprising a cylinder, a piston movable within the cylinder and a piston rod connected to the piston, the piston and consequentially the piston rod being moveable between an extended condition, wherein the piston rod extends into the primary chamber beyond the liquid outlet thereby to engage and displace the flush plug into the open condition, and a retracted condition, wherein the piston rod is retracted from the primary chamber and liquid outlet such that the flush plug is free to seat on the flush valve seat in its closed position.

9. A cistern according to claim 8, wherein the hydraulic actuator includes an actuator supply inlet for supplying liquid to the hydraulic actuator thereby to drive the piston and piston rod into at least one or the other of the extended or retracted conditions; and further wherein the actuator supply inlet is connectable to a municipal mains or other liquid supply, the hydraulic actuator including a biasing means for biasing the piston and piston rod into at least one or the other of the extended or retracted conditions; characterised in that the liquid inlet for filling the primary chamber of the cistern with liquid is connectable to the same municipal mains or other liquid supply to which the hydraulic actuator is connectable, the liquid inlet and the actuator supply inlet being connectable to such municipal mains or other liquid supply by fill plumbing.

10. A cistern according to claim 9, wherein the fill plumbing includes the fill valve, for opening or shutting off flow of liquid from the liquid supply into the primary chamber, and an actuator supply inlet valve, for opening or shutting off flow of liquid to the hydraulic actuator, and further wherein the valves are operatively controlled by the controller in response to the input instruction via the flush plate such that:

(i) in the first flushing condition, the actuator supply inlet valve is opened thereby to drive the piston and piston rod into the extended condition so as to unseat the flush plug for the first flush time to release the first volume of liquid from the primary chamber;

(ii) in the second flushing condition, the actuator supply inlet valve is opened thereby to drive the piston and piston rod into the extended condition so as to displace and unseat the flush plug for the second flush time thereby to release the second volume of liquid from the primary chamber; and (iii) in other conditions other than the first or the second flushing conditions, with the actuator supply inlet valve closed, the fill valve is opened to allow the flow of liquid through the liquid inlet thereby to fill the primary chamber.

11. A cistern according to claim 10, wherein one or more of the valves are solenoid valves, or magnetically actuated valves actuated by valve actuators located on or near the flush plate.

12. A cistern according to claim 11, wherein the valve actuators are at least one first magnetic body and the magnetically actuated valves comprise at least one second magnetic body located thereon such that actuation of the valve actuators actuates the opening and closing of the magnetically actuated valve:

the first and the second magnetic bodies: (i) both being magnets; or (ii) being respectively a magnetic body and a member made from a magnetically reactive material, or vice versa; and further wherein:

the valve actuators, through actuation by the flush buttons or flush sensors of the flush plate, are mechanically movable closer to and further away from the second magnetic body of the magnetically actuated valve thereby to cause the magnetically actuated valve to open and close;

at least one of the valve actuators and the second magnetic body are electrically energisable to cause the magnetically actuated valve to open and close;

the magnets being permanent magnets or electromagnets.

13. A cistern according to claim 12, wherein where the flush plug:

has a specific gravity greater than the liquid stowable in the primary chamber, the flush plug is retainable in the open position by the actuator, held for the duration of the flush time, in the extended condition.

14. A cistern according to claim 13 further including a hydro-generator for powering at least the controller and the solenoid valves, and a communications module for enabling the programming of the controller.

15. A cistern according to claim 14, wherein the cistern has an overall dimension of 1500 to 1800 millimetres (height), 250 to 350 millimetres (width) and 80 to 120 millimetres (depth) such that when built into or behind a wall, everything other than the flush plate is concealed from view.

* * * * *